US005858096A

United States Patent [19]

Madrzak et al.

[11] Patent Number: 5,858,096

[45] Date of Patent: Jan. 12, 1999

[54] APPLICATION UNIT FOR THE DIRECT OR INDIRECT APPLICATION OF A LIQUID OR PASTY MEDIUM ONTO A MOVING MATERIAL WEB

[75] Inventors: Zygmunt Madrzak, Heidenheim; Manfred Ueberschär, Nattheim; Benjamin Méndez; Michael Trefz, both of Heidenheim; Ingo Gottwald, Steinheim; Martin F. Kustermann, Heidenheim, all of Germany

[73] Assignee: Voith Sulzer Papiermaschinen GmbH, Heidenheim, Germany

[21] Appl. No.: 708,092

[22] Filed: Aug. 30, 1996

[30] Foreign Application Priority Data

Sep. 6, 1995 [DE] Germany ..... 195 32 920.1
Dec. 29, 1995 [DE] Germany ..... 195 49 085.1

[51] Int. Cl.[6] ..... B05C 3/02

[52] U.S. Cl. ..... 118/410; 118/404; 118/405; 118/411; 118/416; 118/419; 239/451; 239/455; 239/456; 239/460; 239/502; 239/507; 239/512; 239/516

[58] Field of Search ..... 118/404, 405, 118/416, 410, 411, 419, 612; 425/382.4, 466; 239/451, 455, 456, 459, 460, 502, 507, 509, 512, 513, 516

[56] References Cited

U.S. PATENT DOCUMENTS

| | | | |
|---|---|---|---|
| 3,133,313 | 5/1964 | Corbett | 425/466 |
| 3,912,436 | 10/1975 | Bailly | 425/466 |
| 4,327,662 | 5/1982 | Damrau | 118/410 |
| 4,387,663 | 6/1983 | Alheid | 118/419 |
| 4,503,804 | 3/1985 | Damrau | 118/410 |
| 4,534,309 | 8/1985 | Damrau et al. | 118/410 |
| 4,675,230 | 6/1987 | Innes | 118/411 |
| 4,774,109 | 9/1988 | Hadzimihalis et al. | 118/411 |
| 4,791,879 | 12/1988 | Eklund et al. | 118/410 |
| 4,892,473 | 1/1990 | Elia et al. | 425/382.4 |
| 5,109,792 | 5/1992 | Baldini | 118/410 |
| 5,209,410 | 5/1993 | Wichmann et al. | 239/696 |
| 5,226,963 | 7/1993 | Shibata et al. | 118/410 |
| 5,284,430 | 2/1994 | Tomic et al. | 425/382.4 |
| 5,436,030 | 7/1995 | Damrau | 118/410 |
| 5,599,392 | 2/1997 | Liang et al. | 118/410 |
| 5,603,767 | 2/1997 | Damrau | 118/411 |
| 5,665,163 | 9/1997 | Li et al. | 118/419 |

FOREIGN PATENT DOCUMENTS

| | | | |
|---|---|---|---|
| 0 612 363 | 8/1994 | European Pat. Off. | B05C 11/10 |
| 2 507 108 | 12/1982 | France | B05C 5/02 |
| 1072378 | 12/1959 | Germany | 425/382.4 |
| 1125146 | 3/1962 | Germany | 425/382.4 |
| 3446525 | 8/1985 | Germany | 118/410 |
| 40 10 262 A1 | 3/1990 | Germany | B05C 5/02 |
| 40 10 262 | 2/1991 | Germany | B05C 5/02 |
| 40 00 405 | 11/1991 | Germany | B05C 5/02 |
| 49-6387 | 2/1974 | Japan | 425/466 |
| 50-1894 | 1/1975 | Japan | 425/466 |
| 5-138078 | 6/1993 | Japan | 239/455 |
| 82208477 | 6/1981 | Taiwan | B05C 11/02 |
| 852613 | 11/1979 | U.S.S.R. | 425/466 |
| 1 120 972 | 11/1965 | United Kingdom | B05C 5/02 |
| 2 068 781 | 8/1981 | United Kingdom | B05C 11/10 |
| WO 95/12031 | 5/1995 | WIPO | D21H 23/32 |

*Primary Examiner*—Stanley S. Silverman
*Assistant Examiner*—Michael P. Colaianni
*Attorney, Agent, or Firm*—Taylor & Associates, P.C.

[57] ABSTRACT

The invention relates to an application unit for the direct or indirect application of a liquid or pasty medium (12) onto a moving material web, in particular consisting of paper or board, comprising a dosing gap formed as a free jet nozzle, the dosing gap being formed between a leading lip (4) and a trailing lip (8), and at least one feed channel (14) leading to the dosing gap. The application unit is characterized in that the dosing gap is subdivided in a comb-like manner and has a plurality of defined through-gaps (32) for the liquid or pasty medium (12).

53 Claims, 14 Drawing Sheets

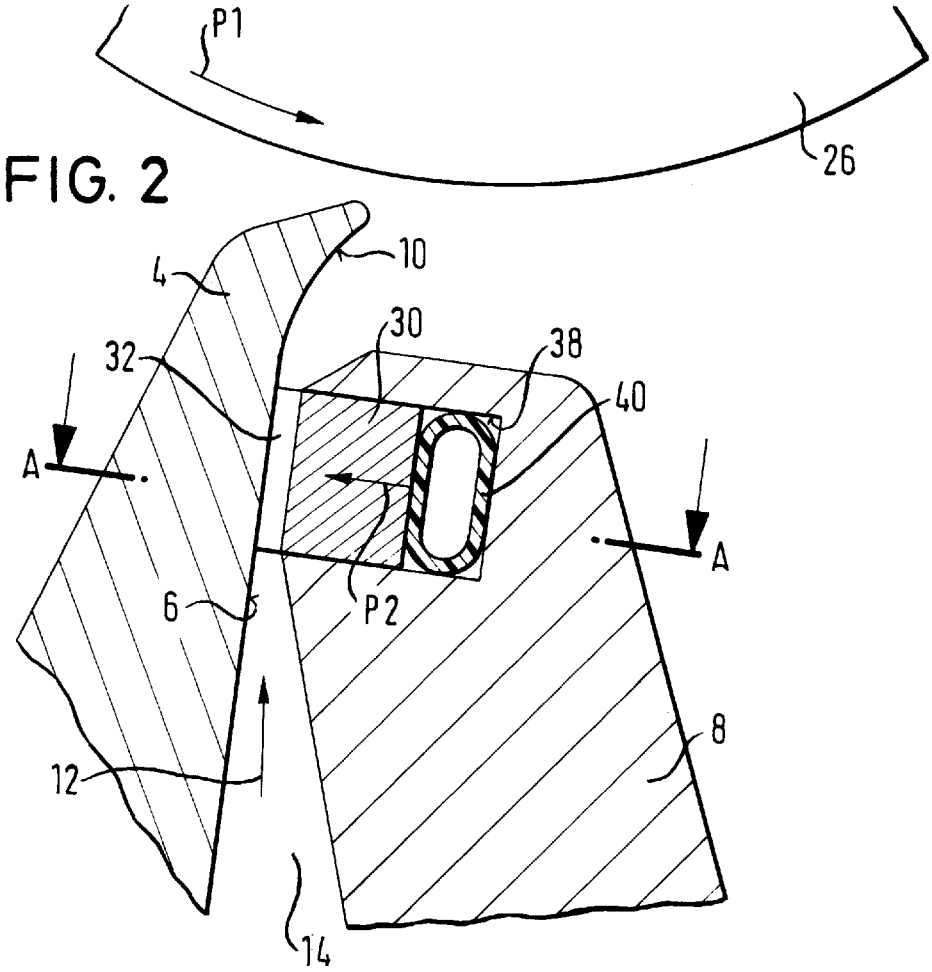
FIG. 2
FIG. 3
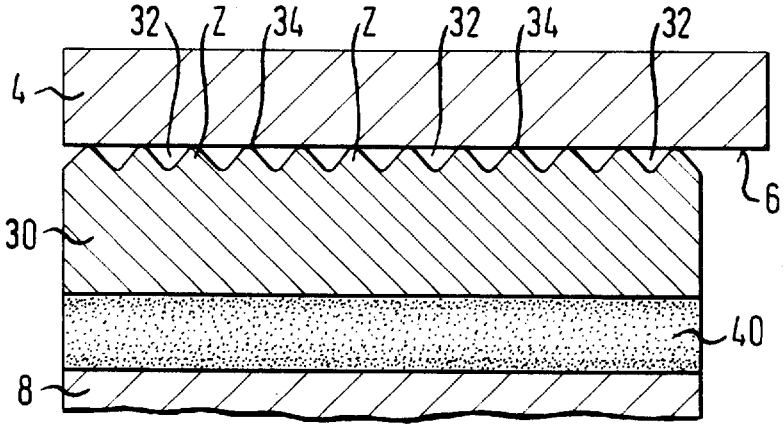

APPLICATION UNIT FOR THE DIRECT OR INDIRECT APPLICATION OF A LIQUID OR PASTY MEDIUM ONTO A MOVING MATERIAL WEB

BACKGROUND OF THE INVENTION

The invention relates to an application unit for directly or indirectly applying a liquid or pasty medium onto a moving material web, in particular consisting of paper or board.

Application units are known in which a dosing gap is formed between two lips as a dosing means operating as a free jet nozzle. This dosing gap is also called a color discharge gap. On account of the formation of a free jet of the liquid or pasty medium passing through the surrounding atmosphere, the designation "Fountain Jet Flow Applicator" (Jet Flow F) is also used for such application units. By means of the free jet, the liquid or pasty medium is directly or indirectly applied onto a moving material web.

In these application units, the liquid or pasty medium is generally supplied by a color distribution pipe arranged within a beam extending across the length of the application unit. The medium passes from the color distribution pipe through through-openings into a compensation space and flows from there via a feed channel to the dosing gap, from which the liquid or pasty medium is subsequently discharged in the form of a free jet. In the direct application of the medium, a material web passes the free jet nozzle and is directly impacted by the free jet of the liquid or pasty medium. In this case, for example, the material web can be guided on the surface of a roll. In indirect application of the medium, the free jet is initially applied onto a carrier surface, for example the surface of an application roll, in order to be transferred in a roll gap, through which the material passes, from the application roll onto the material web. The lip of the two lips forming the dosing gap which lies on the side of the dosing gap at which the application roll in the case of indirect application of the medium or the material web in the case of direct application of the medium moves towards the application unit is called the leading lip. Accordingly, the second lip which lies on the side of the dosing gap at which the application roll or the material web moves away from the application unit is called the trailing lip. The leading lip can have a concave deflecting surface.

Traditionally, in application units of the previously described type, an adjusting device is provided at the trailing lip by means of which the trailing lip can be adjusted in a zonewise manner along the length of the application unit with respect to its distance to the leading lip. As a result of this adjustment of the dosing gap, a certain transverse profile of the liquid or pasty medium applied onto the material web is achieved. Usually, downstream of the free jet applicator, there is a fine dosing device which doctors the applied liquid or pasty medium to the desired applied amount by means of a doctor blade element, for example a blade knife. Further, a collecting trough is arranged between the trailing lip of the application unit and the fine dosing device in order to collect excess liquid or pasty medium which has run off the application unit or the fine dosing device.

An exact adjustment of the dosing gap or the color discharge gap is very work- and time-intensive in conventional application units of the previously described kind and the profiling device for adjusting the gap is very expensive. In particular, when changing the type of liquid or pasty medium, the new adjustment of the dosing gap is very uneconomical. Additionally, on account of the finishing tolerances and possible assembly faults, an exact volumetric dosing across the entire web width can not be reliably guaranteed.

SUMMARY OF THE INVENTION

It is therefore the object of the invention to provide an application unit of the type initially described and a method which allow a very precise gap adjustment in a simple and effective manner and, thus, an exact volumetric dosing across the entire web width as well as a simple and quick readjustment in the case of a type change.

As the dosing gap formed as a free jet nozzle and extending across the length of the application unit is subdivided in a comb-like manner and has a plurality of defined outlet gaps for the liquid or pasty medium on account of its particular geometry, a large number of very precise through-openings for the liquid or pasty medium can advantageously be provided. These through-openings or gaps of the dosing gap subdivided in a comb-like manner operate as free jet nozzles from which the liquid or pasty medium is discharged in the form of a free jet. The "nozzle mounds" in the exiting liquid or pasty medium produced on account of the particular shape of the through-gaps are evened out at the concave curvature of the leading lip to a uniformly thick film so that the material web is provided with a very regular and high quality coating. In an advantageous manner, the inventive application unit therefore permits a simple, effective and precise volumetric dosing of the liquid or pasty medium across the entire web width. Additionally, the inventive application unit also makes it possible to influence the distribution of the liquid or pasty medium on the material web.

According to an advantageous design feature of the invention, the passage cross section of the defined through-gaps decreases in the direction of flow of the liquid or pasty medium. The reduction in the passage cross section can in this case ensue continuously or step-wise. In this manner, the flow and pressure conditions of the liquid or pasty medium can be positively influenced.

Another advantageous embodiment of the inventive application unit is characterized in that the through-gaps are formed by a plurality of predetermined through-openings provided at or in the outlet of the dosing gap. For example, these through-openings, which are preferably provided in a wall bordering the actual dosing gap or in a separate structural component arranged in or at the dosing gap, can be formed as simple bores with a constant cross section or one which tapers in the direction of flow or they can be formed as throughopenings with more complex cross-sectional shapes, such as lens-shaped through-openings or the like and have the same or different sizes and/or a regular or irregular pattern of arrangement.

In this context, a further embodiment has proved to be favorable in which —with reference to the direction of flow of the liquid or pasty medium in the dosing gap —a distribution channel is provided in front of the through-openings which communicates with the through-openings and extends substantially parallel to the longitudinal extension of the dosing gap. This ensures a constant and even distribution and feed of the liquid or pasty medium to the through-openings.

In accordance with another advantageous variant of the invention, the through-gaps are formed by at least one spacer arranged in or at the dosing gap and having a profile-like form. For example, such a spacer can consist of a corrugated thin metal plate, the "corrugation valleys" and "corrugation crests" framed by the walls of the dosing gap forming the plurality of through-gaps for the liquid or pasty medium. The profile of the spacers, i.e. the "corrugation valleys" and "corrugation crests" can in this case have different shapes and patterns of arrangement so that the same or different through-gaps and through-gap arrangements are produced. Additionally, the at least one spacer can consist of one or several parts.

In accordance with the invention, the at least one spacer can be bordered by two guide surfaces extending beyond the outlet of the dosing gap which serve as guiding members for the liquid or pasty medium flowing out of the dosing gap on their way to the location of application. These guide surfaces are preferably formed as smooth, profileless, flat or curved surfaces.

According to a further advantageous embodiment of the inventive application unit, the through-gaps are formed by one or more guide surfaces arranged in or at the dosing gap. For example, in a similar manner as the previously described spacers, such a guide surface projecting beyond the outlet of the dosing gap can consist of a thin corrugated metal plate, the "corrugation valleys" and "corrugation crests" bordered by the walls of the dosing gap forming the plurality of defined through-gaps for the liquid or pasty medium. The profile of the guide surfaces, i.e. the "corrugation valleys" and "corrugation crests" extending in this case substantially parallel to the direction of flow, can have different shapes and patterns of arrangement so that the same or different through-gaps and through-gap arrangements are produced. Additionally, the guide surfaces can be formed of one or more parts. In an advantageous manner, the guide surface therefore performs twin functions, it serves on the one hand as a guide member for the liquid or pasty medium flowing out of the dosing gap on its way to the location of application and, on the other hand, it takes over the function of the mentioned through-gap.

Further, in another embodiment in accordance with the invention, the leading and/or trailing lip is provided with a comb-like gap profile to form a plurality of through-gaps extending substantially parallel to the direction of flow of the liquid or pasty medium in the feed channel. Thus, an effective and precise gap adjustment and, in turn, an exact volumetric dosing of the liquid or pasty medium is possible across the entire web width.

In this regard, it has also proved to be favorable that at least one guide surface for the liquid or pasty medium is arranged between the leading and trailing lips. In this manner, the liquid or pasty medium can flow along both sides of the guide surface and is guided in a precise manner to the location of application.

According to a further advantageous design feature of the invention, a profiled strip is provided in the dosing gap which has a plurality of defined through-gaps that extend substantially parallel to the direction of flow of the liquid or pasty medium in the feed channel. Thus, a large number of very precise through-openings for the liquid or pasty medium can be provided. In particular, when using a profiled strip which is arranged on the leading or trailing lip, the profiled lip can lie precisely against the respective opposite lip, i.e. the leading or trailing lip. Assembling or manufacturing errors can therefore be practically completely compensated for and a further profiling is not necessary. The through-gaps of the profiled strip also act as free jet nozzles from which the liquid or pasty medium is discharged in the form of a free jet. Additionally, the "nozzle mounds" of the exiting liquid or pasty medium produced on account of the particular shape of the profiled strip are equalized at the concave curvature of the leading lip to a uniformly thick film so that the material web is provided with a very regular and high quality coating. Additionally, a simple, effective and very accurate gap adjustment and, thus, an exact volumetric dosing of the liquid or pasty medium can be realized across the entire web width by means of the profiled strip. Further, this inventive design feature also makes it possible to influence the distribution of the liquid or pasty medium on the material web, to more easily clean the profiled strip and, in the case of using more than one profiled strip, to manually or automatically adjust the cross section of the through-gaps of the profiled strip and, thus, in the case of a type change, to also simply and quickly readjust to another type of liquid or pasty medium.

A further advantageous embodiment provides that the profiled strip is movable in a direction extending substantially parallel to its longitudinal extension. Additionally, in accordance with the invention, two or more profiled strips arranged behind one another in the direction of flow of the liquid or pasty medium in the feed channel are provided which can be moved relative to each other in a direction extending substantially parallel to their longitudinal extension. By means of profiled strips designed in this manner, the distribution of the liquid or pasty medium on the material web can be purposefully influenced and, in particular, in the case of two or more profiled strips, a suitable gap adjustment even during operation of the machine and, thus, an exact volumetric dosing also in dependence on different types of liquid or pasty medium used, can be realized. Depending on the selected gap geometry, in the case of relative displacement of the previously mentioned two profiled strips, the through-gaps for the liquid or pasty medium can be adjusted within a broad range.

For this purpose, in accordance with the invention, at least one moving mechanism is provided for moving the profiled strip in a direction extending substantially parallel to its longitudinal extension. This moving mechanism can be a mechanical, electrical, hydraulic or pneumatic apparatus or the like. In the simplest embodiment, for example, a lever linkage connected with the one or more profiled strips and moved by means of an electric motor is conceivable as a moving mechanism.

In connection with the use of one or more profiled strips, it has proved to be advantageous to form the above-mentioned comb-like gap profile at the leading and/or trailing lip preferably in such a manner that it corresponds in terms of its shape with the through-gaps of the profiled strip. Such a gap profile can, for example, take up the function of the above-described second profiled strip which is arranged in the feed channel behind or in front of the first profiled strip as seen in the direction of flow of the liquid or pasty medium. In this manner, the already described gap adjustment and dosing can be carried out particularly favourably.

According to another advantageous design feature of the invention, two profiled strips are arranged opposite each other in the dosing gap, the respective through-gaps of these profiled strips together forming through-openings for the liquid or pasty medium. The two profiled strips can be of the same or different shapes. This makes it possible to provide a greater number of variations in terms of the shape, arrangement and adjustment of the cross section of the through-openings.

With regard to the last-mentioned embodiment, it has also proved to be positive to arrange at least one guide surface between the two opposing profiled strips. Thus, the liquid or pasty medium can flow along both sides of the guide surface and is precisely guided towards the location of application.

Additionally, it has proved to be particularly advantageous that the profiled strip is movable towards the leading or trailing lip in a direction substantially perpendicular to the plane of flow of the liquid or pasty medium flowing in the feed channel. In particular, when using the two opposing profiled strips, this movable arrangement of at least one of the two profiled strips can be used to change the cross section of the through-gaps. Additionally, at least one pressing means is provided in accordance with the invention which presses the profiled strip directly or indirectly towards the leading or trailing lip in a direction substantially perpendicular to the plane of flow of the liquid or pasty medium flowing in the feed channel. Together with the previously mentioned movable arrangement of the profiled strip, it is possible in this manner especially when using a single profiled strip to place the side of the profiled strip having the through-gaps flushly against the surface of the leading lip facing the feed channel and form a plurality of spaced, small and, with respect to their passage cross section, exactly defined openings through which the liquid or pasty medium can pass. This supports an exact dosing of the liquid or pasty medium across the entire web width.

In principle, any suitable mechanical, electrical, magnetic, pneumatic or hydraulic means and the like can be used for the previously mentioned pressing means which fulfills the above-described purpose. Thus, for example, a pressure spring, oppositely polarized magnets or a displaceable cylinder-like hydraulic means are conceivable as pressing means. However, it has proven to be particularly advantageous in this connection that the pressing means is a tube-like member which deforms under the influence of an effective medium such as compressed air and thus achieves the desired effect. Such a means is particularly simple to manufacture and easily integrated in the inventive application unit.

For adaptation to the different embodiments of the inventive application unit, the profiled strip is preferably formed in such a manner that it has a substantially rectangular, polygonal, round, oval or segment-like cross section. In principle, other cross-sectional shapes than those previously mentioned can also be used, for example cross section shapes with curvy sections and the like.

It has proved to be advantageous to produce the profiled strip from an elastic material or a bronze material. The elastic material has the effect that the profiled strip is bendable and particularly favourably lies against the surface of the leading lip facing the feed channel. On the other hand, a bronze material is particularly suitable for lips usually produced from steel on account of the particularly good material pairing. Basically, however, other materials and material combinations are conceivable.

The invention also provides for that the free ends of the profiled strip are connected with one another so that the profiled strip is formed as an endless loop in its longitudinal extension. For this variant, an elastic material has again proved to be particularly favorable. A profiled strip formed as an endless loop can be particularly easily moved in a direction substantially parallel to the longitudinal extension of the profiled strip. In this case, the endless profiled strip can be advantageously guided over a deflection means which in turn can serve as a moving mechanism. Additionally, a continuous movement of the profiled strip in the previously mentioned direction can also be easily realized by means of this endless profiled strip.

The profiled strip is preferably arranged at the leading and/or trailing lip of the application unit because this represents a particularly favorable arrangement in order to be able to use the profiled strip as a free jet nozzle for the application unit.

Further, it has proved to be very positive to form the through-gaps of the profiled strip, as viewed in longitudinal section, to be substantially wavy or sinusoidal in shape or trapezoidal or even to form the material sections of the profiled strip bordering the through-gaps in a tooth-like manner in order to achieve exactly defined passage cross sections and certain flow characteristics of the liquid or pasty medium, in particular in the case of different types of medium. Additionally, on account of the previously mentioned formation of the through-gaps when using two or more profiled strips arranged behind one another in the direction of flow of the liquid or pasty medium in the feed channel, the profiled strips being displaced relative to one another in a direction substantially parallel to their longitudinal extension, a very exact gap adjustment and, with this, dosing of the liquid or pasty medium can be realized, also during operation of the inventive application unit.

In connection with the usual application unit dimensions, a gap depth of the through-gaps of the profiled strip in the order of 0.5 to 4 mm has proved to be advantageous. If the profiled strip with its plurality of defined through-gaps, which are respectively bordered by two adjacent material sections of the profiled strip, is compared with regard to its special shape with a toothed rack, then it is possible to define the module known from tooth-related technology for the profiled strip. The module of the profiled strip with its tooth-like material sections then preferably lies in a range of 0.25 mm to 3 mm. However, the mentioned dimensions and values can vary considerably depending on the type of use.

In order to operate.and service the inventive application unit, it is particularly favorable if the profiled strip is releasably or securely held in or on a holding means. In particular, the releasable arrangement makes it possible to easily remove and exchange the profiled strip such as for servicing purposes or in the case of a change in the type of liquid or pasty medium.

Additionally, it has proved to be particularly useful to make the holding means flexible so that the holding means together with the profiled strip arranged on or in it can be pressed by an appropriate pressing means towards the leading or trailing lip in a direction substantially perpendicular to the plane of flow of the liquid or pasty medium flowing in the feed channel. This in turn makes it possible that the profiled strip lies flushly on the opposite lip and forms through-openings with an exactly defined passage cross section.

In accordance with the invention, the holding means includes at least one section of the feed channel. While the feed channel is usually formed in conventional application units by a wall section of the leading lip and the wall section of a lip which can be folded away for cleaning purposes, the feed channel can now be formed in accordance with the invention as an integral part of the holding means and the construction of the application unit is considerably simplified. This also has a particularly positive effect on the manufacturing costs.

If the holding means has a securing section projecting at least partially into a distribution pipe of the application unit, the holding means can be particularly easily and safely connected with the distribution pipe by means of a slit in the pipe. This variant additionally enhances the integral, simplified mode of construction of the holding means.

Preferably, the holding means also has a filtering means. If the holding means is connected to the distribution pipe by means of the securing section projecting into the pipe, the filtering member is located within the distribution pipe and can filter out impurities and reduce locked-in air possibly present in the liquid or pasty medium. In this manner, a conventional deaerating means can be saved.

Since a holding means according to the previously described integral mode of construction cannot be cleaned as in a conventional application unit by folding away the forward wall, it is provided for in accordance with the invention that the holding means comprises a sonotrode. By means of the sonotrode, the impurities within the feed channel can be simply and effectively loosened and removed in a cleaning step together with the liquid or pasty medium.

To avoid impurities caused by the liquid or pasty medium or its residues, a running-off surface which adjoins the profiled strip is provided on the side of the profiled strip opposite the lips.

The feed channel of the inventive application unit is preferably designed such that it continuously tapers towards the profiled strip. This promotes a pressure compensation in the feed channel across the entire web width and, with this, a uniform distribution and dosing of the liquid or pasty medium.

Finally, at least one cleaning means for cleaning the profiled strip is provided for the inventive application unit. This cleaning means can be designed as a basin or the like filled with or through which a cleaning agent flows, wherein the profiled strip is led through the basin, or the cleaning means can be formed as a spraying means or the like which sprays cleaning agent onto the profiled strip. The first-mentioned variant of the cleaning means is particularly suitable in connection with a profiled strip formed as an endless loop.

In accordance with a further advantageous design feature of the invention, it is provided for that a flow channel tapering in the direction of flow of the liquid or pasty medium adjoins the outlet side of the through-gaps.

As already revealed above, in an embodiment of the invention, a concave deflecting surface directly adjoining the outlet of the through-gaps is used to even out the "nozzle crests" and "nozzle valleys" of the liquid or pasty medium flowing out of the dosing gap, i.e. the through-gaps, which are formed by the through-gaps, the medium then impingings a free jet on the application roll opposite the application unit or on the material web moving on a counter-roll. When using certain types of liquid or pasty medium, it has been noted that, on account of the use of the concave deflecting surface adjoining the outlet side of the through-gaps, the required uniformly thick applied film cannot or cannot always be realized. This leads to an uneven thickness of the coating on the material web and therefore to a disimprovement in the quality of the product processed by means of the application unit. Consequently, even though types of liquid or pasty medium are used which are difficult in terms of processing, an additional demand is to be made on the inventive application unit, namely to achieve an evenly applied film of the same thickness across the width of the application unit so as to produce a very regular and high quality coating. As a result of the flow channel which adjoins the outlet side of the through-gaps and tapers in the direction of flow of the liquid or pasty medium, when using such critical types of liquid or pasty medium which normally cannot or cannot always be processed to an acceptable applied film by using a concave deflecting surface, it is now also possible to achieve an even and uniformly thick coating on the material web and, as a result, an improvement of the coating as well as a high quality end product.

An advantageous design variant of the invention provides for that the mentioned flow channel tapers continuously or discontinuously in the direction of flow of the liquid or pasty medium. In this manner, the geometry of the flow channel can be adapted to the shape of the through-gaps of the dosing gap, the respective flow conditions and the respectively used type of liquid or pasty medium.

A further advantageous design feature of the invention is that the flow cross section of the flow channel is adjustable. The adjustability permits a quick and uncomplicated adaptation to different relevant factors which influence the quality of the coating to be produced, for example the type of liquid or pasty medium that is used, the flow velocity in the flow channel and, with this, the speed of the free jet and the like.

In this connection, it has also proved to be of an advantage to make the flow cross section of the flow channel adjustable and/or selectively locally adjustable across the entire width of the application unit, for example zone-by-zone across the width of the application unit. A locally selective adjustment may serve to compensate local manufacturing inaccuracies or to realize a transverse profile of the applied liquid or pasty medium which has a different shape in sections, for example, that it is flattened or the like at the edges of the material web.

If a local thin part is provided in the area of the output side of the through-gaps of the dosing gap in the leading and/or trailing lip, this thin part permitting the adjustability of the flow cross section of the flow channel, the desired adjustment of the flow channel cross section can be realized in a particularly simple manner which is also effective and favorable in flow terms.

A further advantageous inventive variant provides for that at least one wall of the flow channel is formed of at least one plate-like or blade-like component moveable towards or away from the respectively opposing leading or trailing lip, said component permitting the adjustability of the flow cross section of the flow channel. The movability of this component can be realized by elastic deformation of the component itself or by providing a suitably pivoted or hinged connection to a section of a lip. When adjusting the flow cross section of the flow channel, the plate-like or blade-like component forming the wall of the flow channel normally conducts a pivoting movement. However, it is equally conceivable to move this component in a translatory manner. Further, the plate-like or blade-like component can have its own useful securing system for fixed or releasable mounting on a suitable section of a lip. This securing system can itself include the above-mentioned hinged or pivotable attachment to the lip or another component provided for this purpose. Thus, the desired adjustment of the flow channel cross section is again provided in a manner which is particularly simple, effective and favorable in flow terms.

In accordance with the invention, at least one adjusting means is provided as a further design feature for adjusting the flow cross section of the flow channel. This adjusting means can be a manually actuatable or even automatic adjusting means, the latter also including regulatable and/or remote-controllable adjusting means. Such an automatic adjusting means is particularly advantageous in view of an adjustment of the flow channel during the running operation of the application unit. The control of the adjusting means can then take place centrally and a controlled coupling of the adjusting means with other components of the application unit is additionally made possible. In particular, it is also conceivable to include the automatic adjusting means in an automatic control circuit which regulates the adjusting means on the basis of measured values of the transverse profile of the applied liquid or pasty medium. This permits the quickest possible adaptation of the application unit to varying conditions such as irregularities during operation or the use of a different type of liquid or pasty medium.

It has proved to be particularly convenient in constructive terms to arrange such an adjusting means in or on the leading and/or trailing lip.

Further advantageous embodiments of the adjusting means consist in these having a mechanical, hydraulic, pneumatic, electrical, thermal, magnetic, magnetostrictive or piezoelectric adjusting mechanism or the like. Such adjusting mechanisms can be realized in terms of their structural form in a plurality of ways, combinations of the adjustment mechanisms and functional principles also being possible. For example, adjusting screws, lever mechanisms, electrical, pneumatic or hydraulic actuators or servo motors and many others are conceivable.

Another inventive design feature provides for that a concave deflecting surface for the liquid or pasty medium adjoins the flow channel, the deflecting surface being pivotable in the area of the outlet of the flow channel about an axis substantially parallel to the longitudinal extension of the application unit. In an advantageous manner, this permits a very precise adjustment of the angle of impingement of the liquid or pasty medium on the application roll or the moving material web within a large angular range. For this purpose, only a simple adjustment is necessary, i.e. a pivoting of a very small component of the application unit, namely the concave deflecting surface, on account of which the manufacturing effort and manufacturing costs are considerably reduced. Further, the forces acting on the structural components of the application unit as a result of the adjustment or repositioning of the concave deflecting surface can be kept small and, with this, a light and cheaper mode of construction can be realized. Additionally, no noteworthy displacement of the "impingement line" of the liquid or pasty medium onto the application roll or the moving material web occurs upon adjustment. It is also to be particularly emphasized that an adjustment of the impingement angle by pivoting the concave deflecting surface can take place entirely independently of the adjustment of the flow cross section of the flow channel and vice versa.

In addition, it has also proved to be convenient that the concave deflecting surface is pivotable zone-by-zone about an axis running substantially parallel to the longitudinal extension of the application unit in the area of the outlet of the dosing gap. For this purpose, the concave deflecting surface is usefully subdivided into zones. In this manner, the impingement angle of the liquid or pasty medium on the moving material web can be locally varied and, with this, the application onto the material web can be influenced accordingly. For example, this may be necessary to compensate local manufacturing inaccuracies or to produce a specific transverse profile on the material web. By uniformly swinging the concave deflecting surface zone-by-zone, it is naturally also possible to achieve a unitary adjustment of the impingement angle along the entire length of the application unit.

The previously described swinging or pivoting of the concave deflecting surface for the purpose of adjusting the impingement angle can ensue with the assistance of at least one suitable adjusting or changing means, this means being actuatable manually and/or automatically and/or in a remote-controlled manner.

The initially described object of the invention is also solved by an inventive process for uniformly dosing a liquid or pasty medium in an application unit which comprises the features of claim 29. This process offers the advantages already described in connection with the inventive application unit.

A further embodiment of the inventive process provides for that the area of passage of the through-gaps of the regulating location is altered in order to regulate the applied amount of liquid or pasty medium.

BRIEF DESCRIPTION OF THE DRAWINGS

Exemplary embodiments of the invention with additional embodiment details and advantages are described and explained in more detail in the following with reference to the enclosed drawings, in which:

FIG. 2 shows a schematically enlarged view of the area X in FIG. 1 with a first embodiment of an inventive profiled strip, FIG. 3 shows a schematic side view rotated about 90° along the line 3—3 in FIG. 2.

In the following description, to avoid repetition, the same structural parts are denoted with the same reference signs so far as no further differentiation is required.

DETAILED DESCRIPTION OF THE INVENTION

Figure 1:
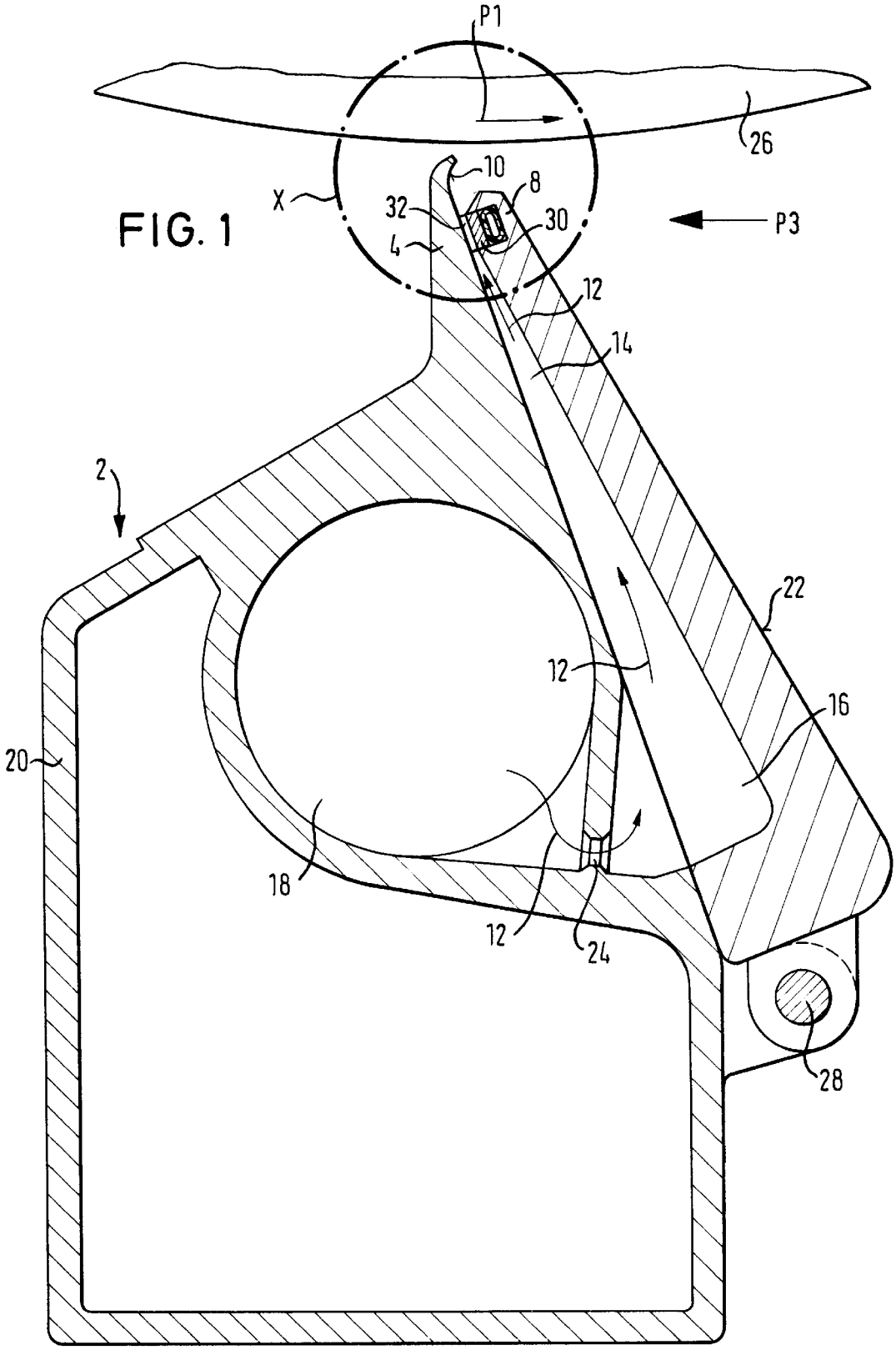
FIG. 1 shows a schematic cross-sectional view of a first exemplary embodiment of the inventive application unit.

As shown in FIG. 1 in a schematic cross-sectional view, a first exemplary embodiment of the inventive application unit 2 comprises a beam 20 which extends along the entire length of the application unit. In the beam 20, there is a distribution pipe 18, which is usually also called a color distribution pipe, for the liquid or pasty medium to be applied. Connected by through-openings 24, this distribution pipe 18 adjoins with a compensation space 16 which continues in the form of a feed channel 14. The feed channel 14 opens into a dosing gap which is formed as a free jet nozzle, the dosing gap itself being formed between a leading lip 4 and a trailing lip 8. The feed channel 14 is preferably shaped in such a manner that it continuously tapers towards the dosing gap. The dosing gap itself is subdivided in a comb-like manner and has a plurality of defined through-gaps for the liquid or pasty medium. Serving as such a dosing gap in the present exemplary embodiment is a profiled strip 30 which will be described in more detail in the following. Additionally, the feed channel 14 is relatively wide in the area of the profiled strip 30 as compared to conventional application units in order to provide pressure compensation across the entire machine width.

At the upper free end of the leading lip 4 which extends beyond the free end of the trailing lip 8, there is a concave deflecting surface 10. The liquid or pasty medium and its direction of flow is indicated by arrows 12. Opposite the application unit 2, there is an application roll 26 for an indirect application of the medium to be applied. The rotational direction of the application roll 26 is indicated with an arrow P1.

A front wall 22 to which the trailing lip 8 is undetachably secured is rigidly fixed in operation but can be folded down about a hinge 28 if necessary, for example, for cleaning purposes. The rear side of the front wall 22, i.e. the side facing away from the feed channel 14, is formed as a running-off surface for the excess liquid or pasty medium.

In this application unit 2 according to FIG. 1, the liquid or pasty medium 12 is first supplied via the color distribution pipe 18, then passes into the compensation chamber 16 and flows through the feed channel 14 through the through-gaps 32 of the profiled strip 30, from which the medium then emerges as a free nozzle, not illustrated, a deflection of the application jet in the direction of the tangent at the application roll 26 taking place on account of the concave deflecting surface 10 of the leading lip 4. The liquid or pasty medium 12 is applied in the form of this free jet onto the surface of the application roll 26 and then, after passing a downstream fine dosing means, which is not shown and at which the applied medium is doctored to a desired applied amount, the medium is supplied to a roll gap through which a material web passes consisting of paper or board, or possibly of a textile material, and the web then takes up the liquid or pasty medium from the application roll 26.

The exemplary embodiment can also be equipped with an adjusting means for the leading lip 4. However, the adjusting means is not shown in the figures.

In FIG. 2, which shows a schematic enlarged view of the area X in FIG. 1, further details of the profiled strip 30 and its arrangement according to a first embodiment can be seen. The profiled strip 30 is arranged at the trailing lip 8 and extends essentially across the entire width of the application roll 26. As can also be seen in FIG. 2, the profiled strip 30 according to this embodiment has a substantially rectangular cross section and is held at one side in a recess serving as a holding means and located in the upper region of the trailing lip 8. The depth of the recess 38 is greater than the depth of the profiled strip 30 so that the profiled strip 30 in its holding means is moveable substantially perpendicular to the plane of flow of the liquid or pasty medium 12 flowing in the feed channel 14 and in a direction towards the leading lip 4, which is denoted with the arrow P2 in the figure. A pressing means provided between the base of the recess 38 and the rear side of the profiled strip 30 presses the profiled strip 30 directly or indirectly in the direction P2 towards the leading lip 4 perpendicular to the plane of flow of the liquid or pasty medium 12 flowing in the feed channel 14. In the present case, this pressing means is formed as a tube-like member 40 which deforms under the influence of a medium such as compressed air and thus moves the profiled strip 30 in the previously mentioned direction P2 by the direct application of force. For this purpose, a pressure generating means is provided which is not illustrated in the drawings and exerts a suitable pressure on the medium in the tube-like member 40. By deaerating the tube-like member 40, the profiled strip 30 can also be removed quickly for cleaning purposes.

As shown in FIG. 3, which illustrates a schematic longitudinal cross section along the line A–A in FIG. 2 rotated about 90°, the profiled strip 30 comprises a plurality of defined through-gaps 32 which extend substantially parallel to the direction of flow of the liquid or pasty medium in the feed channel 14. In accordance with FIG. 3, the through-gaps 32 are similar to or have the shape of a wavy or sinusoidal form. Further, the through-gaps 32 of the profiled strip 30 are directed towards the leading lip 4 so that the profiled strip 30 lies against the surface 6 of the leading lip 4 facing the feed channel 14 under the influence of the tube-like pressing means 40, wherein the heads 34 of the tooth-like material sections of the profiled strip which respectively border the through-gaps 32 abut the previously mentioned surface 6 and the through-gaps 32 thus form a plurality of spaced small openings through which the liquid or pasty medium 12 can pass.

The profiled strip 30 is releasably held in its holder 38 so that it can be removed easily after folding away the front wall 22 and is then exchanged for another profiled strip or serviced. Naturally, it is also possible to undetachably secure the profiled strip 30 in its holder.

The profiled strip 30 is elastically bendable in the direction towards the lip 4 so that the tooth-like profile section of the profiled strip 30 always abuts uniformly against the lip 4 even in the case of assembly or manufacturing faults and forms through-gaps or through-openings with an exactly defined cross section of passage to therefore guarantee an exact volumetric dosing of the liquid or pasty medium 12 across the entire web width.

Figure 4:
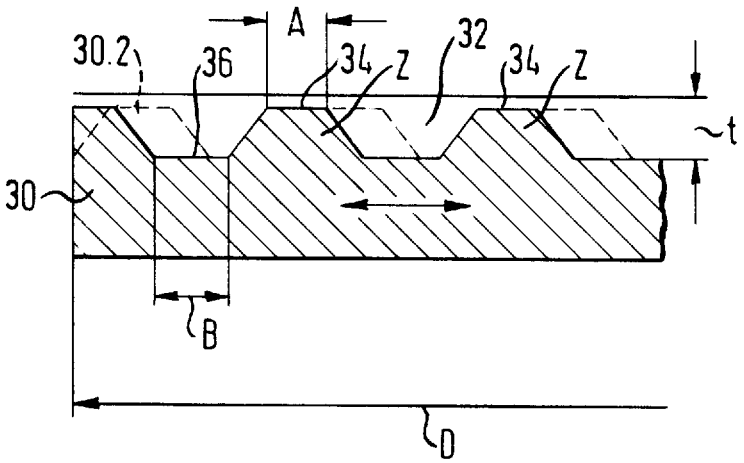
FIG. 4 shows a schematic enlarged section of a profiled strip according to a second exemplary embodiment.

FIG. 4 shows in longitudinal cross section a schematic sectional enlarged view of a profiled strip 30 according to a second embodiment. In this case, the through-openings 32 are substantially trapezoidal or the material sections Z of the profiled strip 30 bordering the through-openings 32 are formed to be tooth-like. The width A of a single "tooth head" 34 of the material section Z and the breadth B of a gap base 36 between two adjacent sections Z must not necessarily be the same in this case. Additionally, the inclination of the flanks of sections Z within a single profiled strip 30 can vary.

The same applies in respect of every other gap shape which is used in the corresponding manner for an inventive profiled strip. The gap depth (t) of the through-gaps 32 of the profiled strip 30 is preferably 0.5 to 4 mm. If one compares the profiled strip 30 with a toothed rack, then the module of the profiled strip preferably lies in the range of 0.25 mm to 3 mm. However, depending on the type of use, the mentioned dimensions and values can vary considerably.

As also indicted in FIG. 4 with a double arrow, the invention provides for the profiled strip 30 to be movable in a direction substantially parallel to its longitudinal extension. Additionally, in accordance with the invention, two or more profiled strips can be arranged in series with one behind the other in the direction of flow of the liquid or pasty medium 12 in the feed channel 14 and can be displaceable relative to one another in a direction substantially parallel to their respective longitudinal extension D. A second profiled strip 30.2 is indicated in FIG. 4 by the dashed line. The particular advantage of two or more relatively displaceable profiled strips consists in that a suitable gap adjustment and, with this, an exact volumetric dosing can be realized even during operation of the machine and in dependence on different types of the liquid or pasty medium being used. Depending on the selected gap geometry, the through-gap 32 formed for the liquid or pasty medium can be adjusted in a broad range by relative displacement of the profiled strips 30 and 30.2. Additionally, as a result of movement of the profiled strip 30, the distribution of the liquid or pasty medium on the material web can be influenced. A suitable moving mechanism for moving or adjusting the profiled strips 30, 30.2 provided in accordance with the invention is not shown in FIG. 4.

Also in accordance with the invention, the leading lip 4 is provided with a comb-like gap profile to form a plurality of through-gaps extending substantially parallel to the direction of flow of the liquid or pasty medium 12 in the feed channel 14. This gap profile of the leading lip 4 is preferably formed in such a manner that it corresponds in terms of its shape to the through-gaps 32 of the profiled strip 30. In this manner, the through-gaps of the gap profile of the leading lip 4 and the through-gaps 32 of the profiled strip 30 together form through-openings for the liquid or pasty medium 12. The gap profile of the leading lip 4 can be formed as a projection extending beyond the actual lip. As in the case of the variant according to FIG. 4, it is also conceivable to arrange the gap profile in front of or behind the profiled strip 30 in the direction of flow of the liquid or pasty medium 12 so that the gap profile effectively functions as a second profiled strip 30.2. An embodiment in which the leading lip is provided with such a gap profile is not illustrated in the figures.

Figure 5:
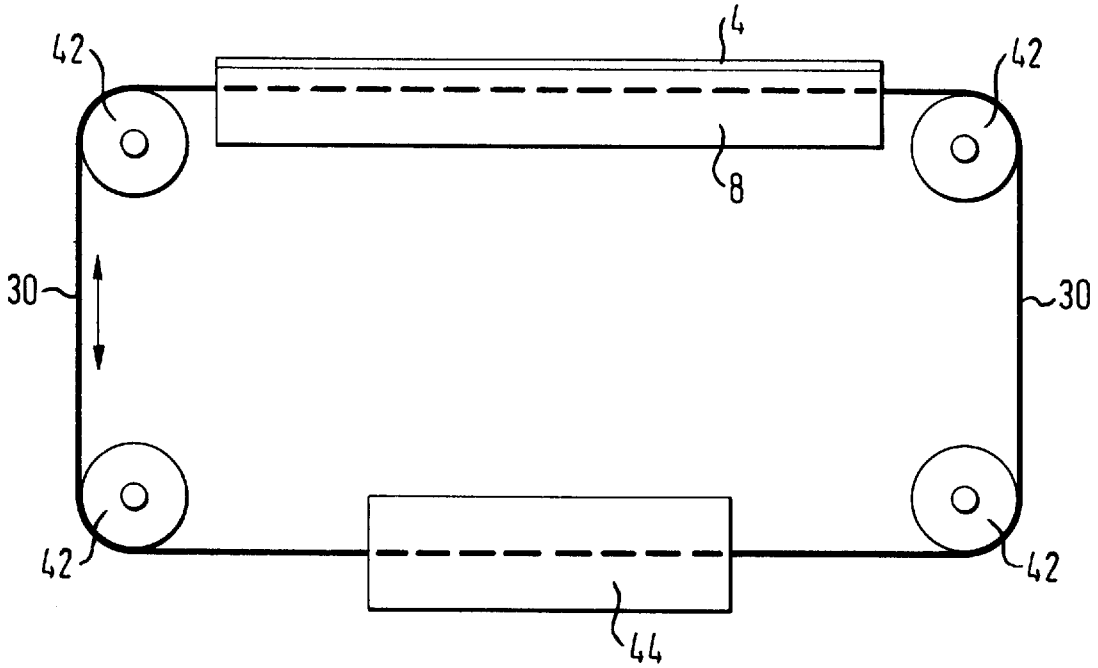
FIG. 5 shows in the viewing direction according to arrow P3 in FIG. 1 a schematic basic sketch of a third embodiment of the inventive profiled strip.

A further advantage of the inventive moveable arrangement of the profiled strip 30 becomes apparent from FIG. 5. As seen in the direction of viewing according to the arrow P3 in FIG. 1, this shows a schematic basic sketch of a third embodiment of an inventive profiled strip. In this case, the profiled strip 30 is formed in its longitudinal extension as a belt-like endless loop which is guided over several deflection means 42 of which one serves as a drive means for moving the profiled strip 30. The movement of the profiled strip 30 is indicated in FIG. 5 with a double arrow. The lower section of the endless profiled strip 30 is lead through a cleaning apparatus 44. This can be a basin filled with cleaning fluid, a spraying means which sprays cleaning agent onto the profiled strip, or similar means. Thus, upon movement of the profiled strip 30, a cleaning of the profiled strip section respectively passing through the cleaning means 44 takes place.

The previously mentioned movement of the endless profiled strip 30 can take place in almost any desirable manner in a direction substantially parallel to its longitudinal extension D. Preferably, however, a continuous, oscillating or step-wise movement is carried out in the described direction.

To realize the particular embodiment according to FIG. 5, the profiled strip 30 is preferably manufactured from an elastic or elastically bendable material. For other variants of the profiled strips, a bronze material is generally to be given preference because this enables a particularly suitable material pairing with the lips 4 and 8, which are usually manufactured from steel. However, other material combinations are also conceivable.

Figure 6:
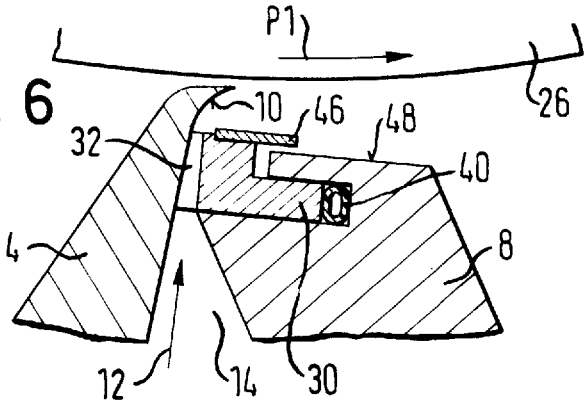
FIG. 6 shows a schematic view of a fourth embodiment of an inventive profiled strip analogous to the view in FIG. 2.

FIG. 6 is a schematic view of a fourth-embodiment of an inventive profiled strip analogous to the view in FIG. 2. This profiled strip 30 has an essentially L-shaped cross section and is provided on its surface facing the application roll 26 with a cover 46 projecting over the surface of the lip 8. The surface of the profiled strip 30 facing away from the lip 8 is formed as a running-off surface 48 for excess liquid or pasty medium 12.

Figure 7:
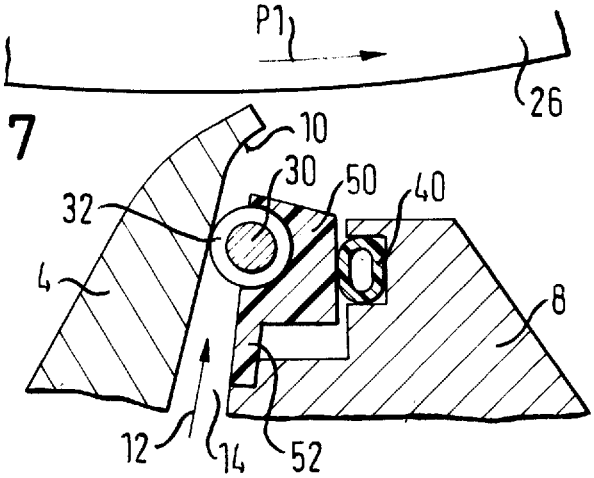
FIG. 7 shows a schematic view of a fifth embodiment of an inventive profiled strip analogous to the view in FIG. 2.

FIG. 7 is a schematic view of a fifth embodiment of an inventive profiled strip analogous to the view in FIG. 2. In this embodiment, a profiled strip 30 having an essentially round or oval cross section is used (for example, even a profiled doctor blade known per se) and is fixed in a flexible holder 50. The flexibility of the holder 50 can be provided by using a corresponding suitable flexible or elastic material or even, as shown in FIG. 7, by a locally thinner material section 52 of the holder 50. In this manner, the holder 50 with the profiled strip 30 can elastically deform under the influence of a force and press the profiled strip in the direction of the leading lip 4. In the present example, this force is produced by a pressing means 40 already described in more detail in connection with FIG. 2. However, the pressing means 40 does not act directly on the profiled strip 30 in this case but indirectly through the holder 50.

Figure 8:
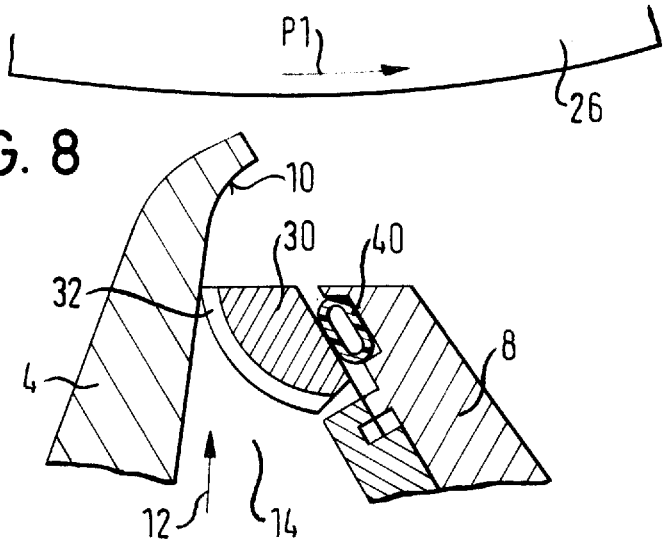
FIG. 8 shows a schematic view of a sixth embodiment of an inventive profiled strip analogous to the view in FIG. 2.

FIG. 8 is a schematic view of a sixth embodiment of an inventive profiled strip analogous to the view in FIG. 2, the profiled strip 30 having a segment-like cross section.

The profiled strip can in principle also have other profile cross sections than those previously described, for example, other polygonal or curved cross sections.

Figure 9:
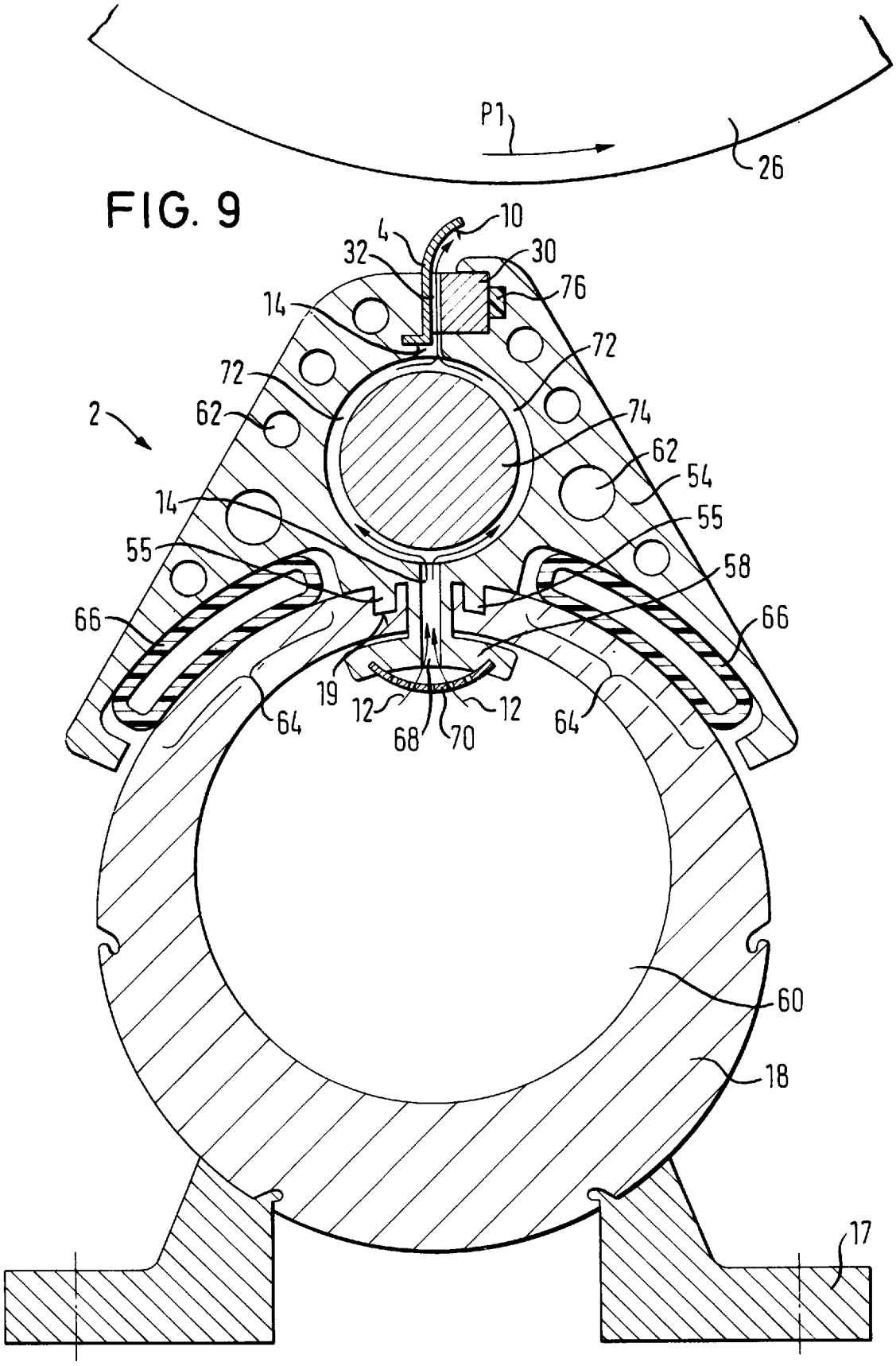
FIG. 9 shows a schematic cross-sectional view of a second exemplary embodiment of the inventive application unit.

FIG. 9 shows in a schematic cross-sectional view a second exemplary embodiment of the inventive application unit 2.

This variant has a holder 54 for the profiled strip 30 which tapers conically in the direction towards the application roll 26, the holder 54 being directly placed and fixed on the distribution pipe 18 of the application unit formed as a support body. The lower side of the holder 54 is in this case adapted to the geometry of the distribution pipe 18. Preferably, the distribution pipe 18 has a wall thickness which tapers from a lower to an upper part of the pipe and is fixed on a commonly available support member 17.

The holder 54 is integrally formed or consists of several individual segments and is connected with the distribution pipe 18 by means of an upper slit 56 in the same in that an anchor-like securing section 58 of the holder 54 projects into the interior of the distribution pipe 18. Additionally, two profiled projections 55 of the holder 54 are in engagement with corresponding grooves 19 of the distribution pipe 18. In the case of an integral holder, this can be connected with the distribution pipe 18 by way of laterally sliding it into the slit 56. The holder 54 is preferably manufactured from a plastic or aluminum material. For the purpose of reducing weight, the holder 54 is provided with a plurality of relieving bores although these are not absolutely necessary.

Clamping tubes 66 are also provided between the wall sections 64 of the distribution pipe 18 and the holder 54. These clamping tubes 66 have a similar function to that of the pressing means 40 of the previously described variants. When placed under pressure with an effective medium such as compressed air, these deform and effect an elastic deformation of the two opposing halves of the holder 54 so that the profiled strip arranged between the two halves of the holder 4 is pressed against the opposing lip 54 in an analogous manner to the previously described exemplary embodiments. As a rule, the clamping tubes 66 will not be inflated to the same extent. This results from the fact that it is useful to only place one clamping tube under a load or to place both clamping tubes 66 under different loads because, on account of the different elastic deformation of the holder halves resulting from this and the leading lip 4 with the concave deflecting surface 10 being arranged on one of the halves, the impingement angle of the liquid or pasty medium 12 on the application roll 26 or on the material web can then also be varied.

The holder 54 includes the feed channel 14, the lower end of which opens into the distribution pipe 18 via the securing section 58 projecting into the distribution pipe 18 and the upper end of which opens into the through-gaps 32 of the profiled strip 30 acting as free jet nozzles. A filtering member 70 having a large surface area is provided on the securing section 58 of the holder 54 at the inlet opening 68 of the feed channel 14. This filtering member 70 reduces the size of air possibly entrained in the liquid or pasty medium 12 and filters out impurities. In this manner, a conventional deaerator can be saved. Since the feed channel 14 cannot be opened for the purpose of cleaning by swinging away the wall section as in the embodiment according to FIG. 1, the section of the feed channel 14 lying in the central region of the holder 54 in the variant according to FIG. 9 is expanded in a circular manner and a sonotrode 74 is provided in this hollow space 72. Impurities within the feed channel 14 can be loosened by means of the sonotrode 74 and removed together with the liquid or pasty medium 12 in a cleaning step. Suitable means for activating the sonotrode 74 are not shown in the drawings for the sake of simplicity. If the holder 54 consists of several parts which can be easily removed as described above, then the sonotrode is possibly not required.

The profiled strip 30 has an essentially rectangular cross section in the embodiment according to FIG. 9. A seal 76 is provided at one side of the profiled strip.

Figure 10:
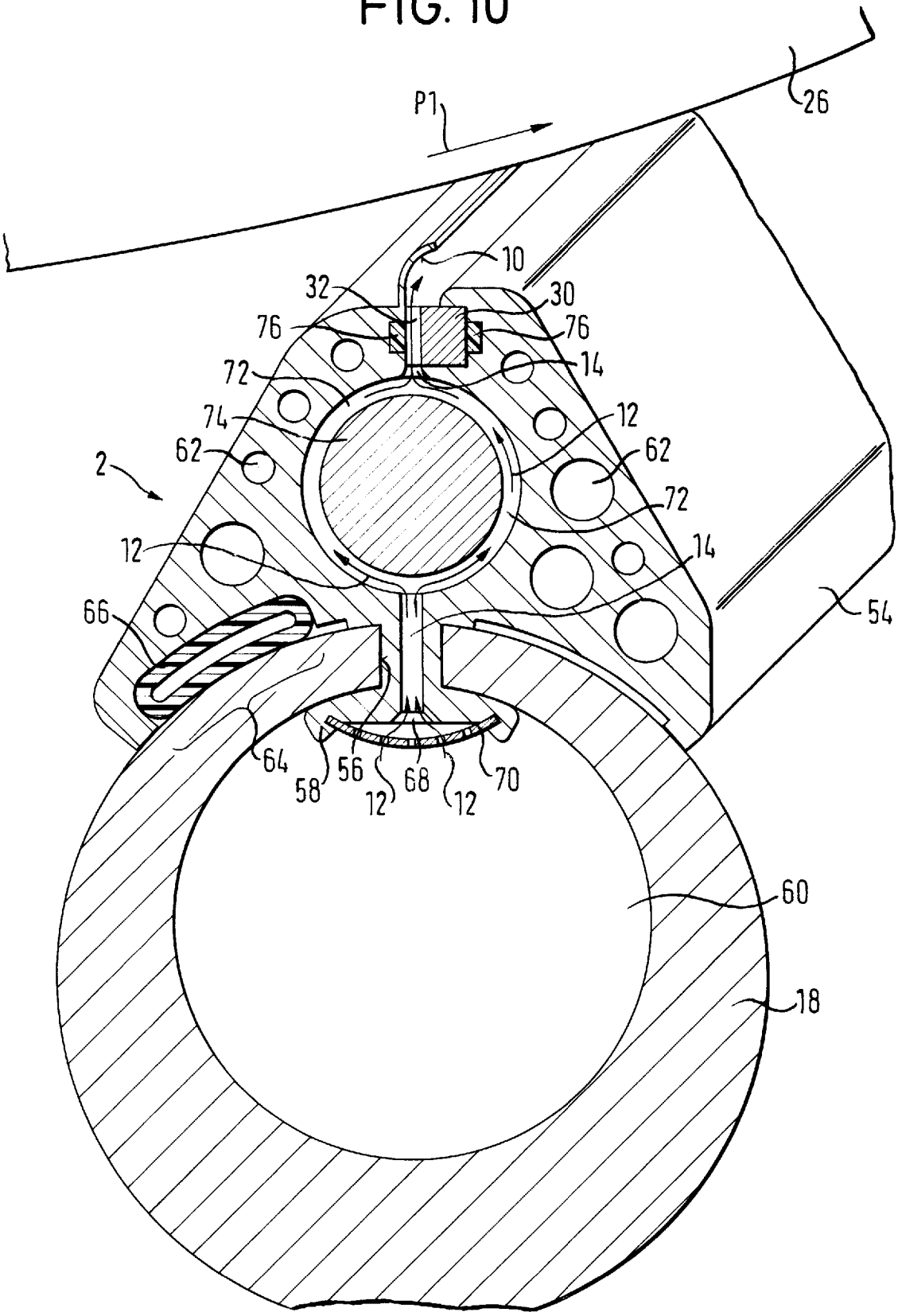
FIG. 10 shows a schematic cross-sectional view of a third exemplary embodiment of the inventive application unit.

FIG. 10 shows a third exemplary embodiment of the inventive application unit 2 in a schematic cross-sectional view. The structure and function of this application unit corresponds substantially to the variant explained in connection with FIG. 9. However, in contrast to this, only one clamping tube 66 is provided and the profiled strip 30 is framed by two seals 76, as is apparent in the drawing.

Figure 11A:
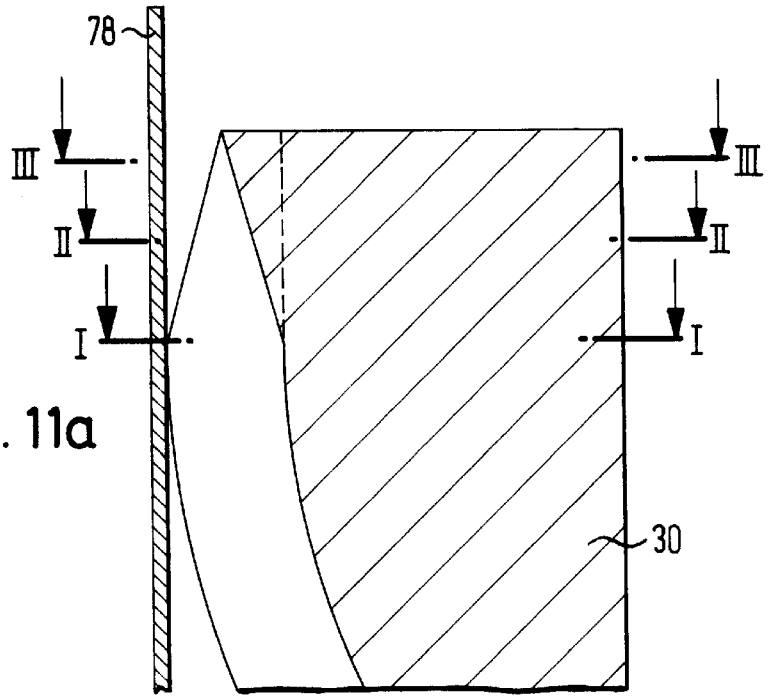
FIGS. 11*a* to e show schematic views of a seventh embodiment of an inventive profiled strip, FIG. 11*a* being a view analogous to FIG. 2, FIGS. 12*a* and 12*b* show a schematic cross-sectional view and plan view of an eighth embodiment of an inventive profiled strip, FIG. 12*a* being a view analogous to FIG. 2, FIGS. 13*a* and b show a schematic plan view and sectional view of a further embodiment of the inventive through-gaps, FIGS. 14*a* and b show a schematic plan view and sectional view of an even further embodiment of the inventive through-gaps.
Figure 11B:
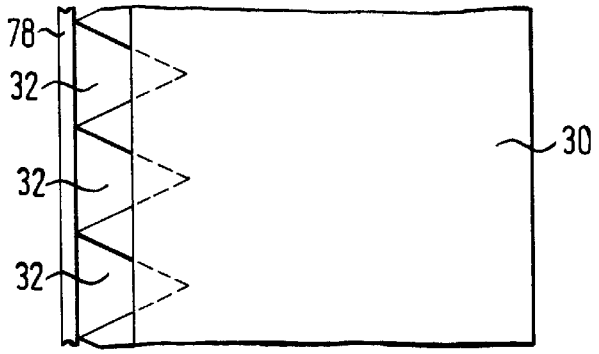
Figure 11C:
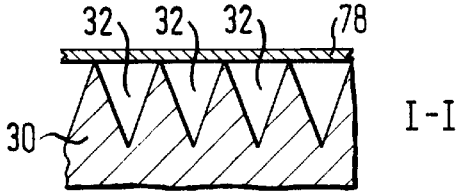
Figure 11D:
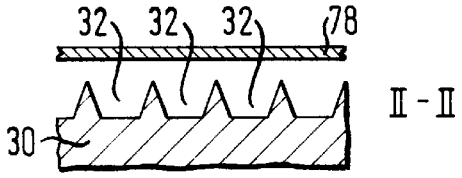
Figure 11E:
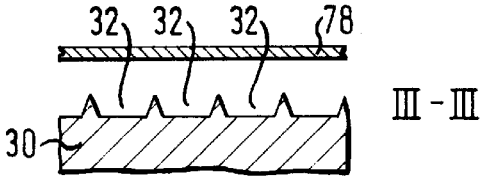

In a schematic view analogous to that of FIG. 2, FIG. 11*a* shows a seventh embodiment of an inventive profiled strip. Similarly as in the variant according to FIG. 8, in the case of the profiled strip 30 according to FIG. 11*a*, the area of the profiled strip 30 associated with the opposing leading lip 4 and including the through-gaps 32 is accurate in cross section and, in accordance with the plan view of FIG. 11*b* and the sectional view according to FIGS. 11*c–e* (FIGS. 11*c–e* are shown in a manner rotated about 90° in comparison to the plan view according to FIG. 11*b*), the through-gaps 32 have a sawtooth-like shape. In contrast to FIG. 8, there is also a guide surface 78 in FIG. 11*a* in the shape of a straight, flat guide plate which projects in this case partially into the dosing gap and beyond the outlet of the dosing gap in the direction of the application roll 26, which is not shown in FIG. 11*a*. As can be seen in the different sectional views according to FIGS. 11*c–e,* the through-gaps 32 are also formed in such a manner that their open cross sections reduce in the direction of flow of the liquid or pasty medium 12, i.e. towards the outlet of the through-gaps 32. In the present case, the reduction in the open cross sections is continuous.

Figure 12A:
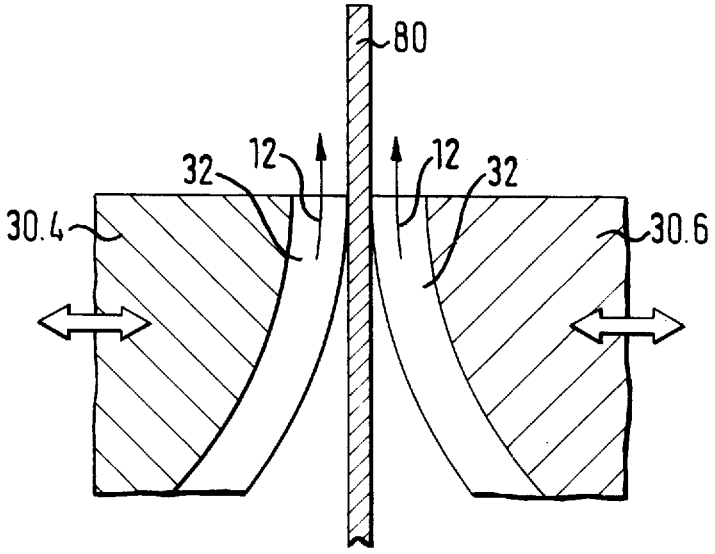
Figure 12B:
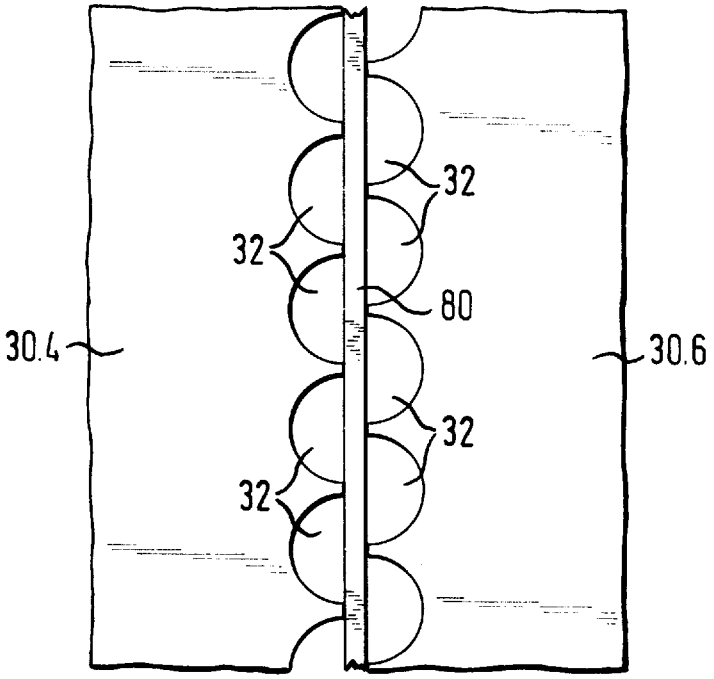

In the eighth embodiment of an inventive profiled strip shown in FIGS. 12*a* and b, there are two profiled strips 30.4, 30.6 which are arranged opposite one another in the dosing gap as illustrated in FIG. 12*a* in the cross-sectional view analogous to that in FIG. 2. In the present case, there is also a straight guide surface 80 which partially projects into the dosing gap and is arranged between the opposing profiled strips 30.4, 30.6 such that the liquid or pasty medium 12 discharged from the through-gaps 32 of the profiled strips 30.4, 30.6 flows along both sides of the guide surface 80 and is guided into the immediate vicinity of the location of application. However, this guide surface 80 is not obligatory. The plan view shown in FIG. 12*b* illustrates that the two profiled strips 30.4, 30.6 lie against the interposed guide surface 80 and the groove-like through-gaps 32 of the profiled strips 30.4, 30.6 respectively have a semicircular area of passage, said through-gaps 32 of the two profiled strips 30.4, 30.6 being offset with respect to each other. As also indicated by the double arrows in FIG. 12*a*, at least one of the two opposing profiled strips 30.4, 30.6 can in principle be moved in the direction substantially perpendicular to the plane of flow of the liquid or pasty medium flowing in the feed channel or the dosing gap such that the total cross section of passage formed by the through-gaps 32 of the two profiled strips 30.4, 30.6 is variable.

Figure 13A:
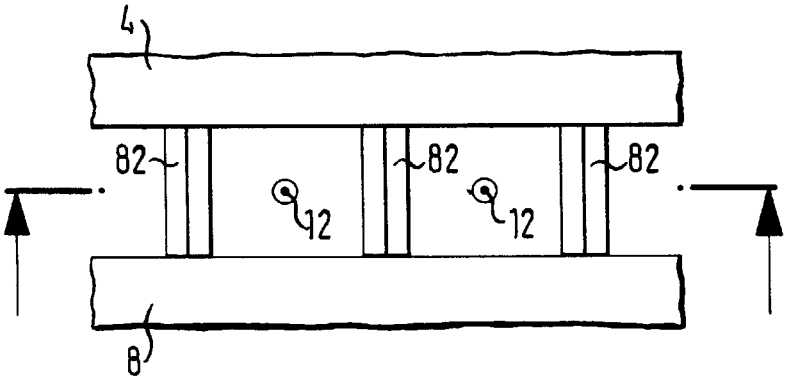
Figure 13B:
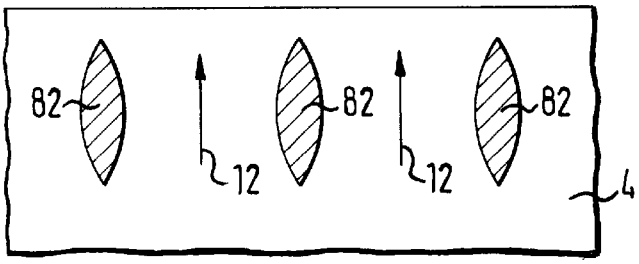

FIGS. 13*a* and 13*b* show a schematic plan view and sectional view of a further embodiment of the inventive through-gaps. As can be seen in FIG. 13*a*, the through-gaps 32 are formed by the intermediate spaces between a plurality of webs 82 arranged adjacent one another in the dosing gap as seen in the longitudinal extension of the dosing gap. The cross-sectional surface of a respective web 82 lying in the direction of flow of the liquid or pasty medium 12 is usefully formed in such a manner as to be favorable to the flow (in the present case the webs have a lens-like cross section), the space between the two adjacent webs 82 preferably being greater than the cross section surface of the webs 82 taken in the direction of flow. The webs 82 can be provided either on an appropriately formed profiled strip or be used as simple spacers in the dosing gap and fixed at that location.

Figure 14A:
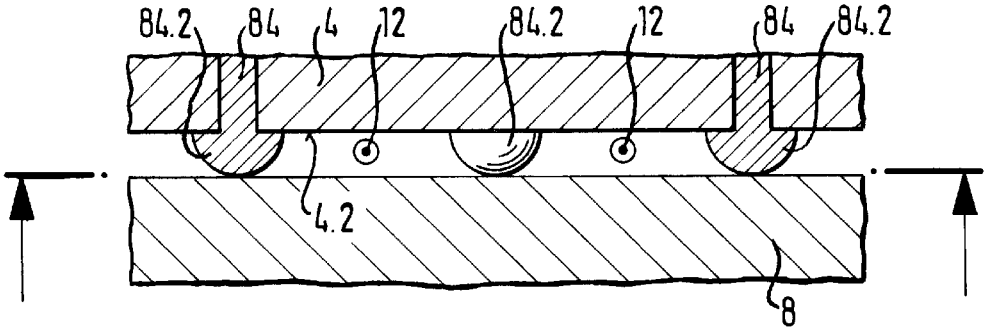
Figure 14B:
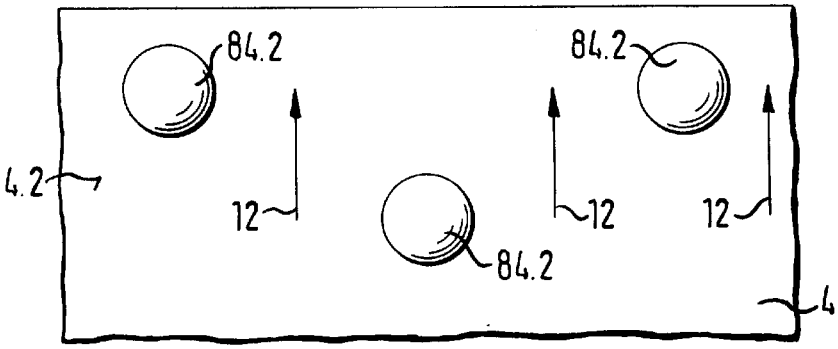

FIGS. 14*a* and b show a further embodiment of the inventive through-gaps of the application unit in a schematic plan view and a sectional view. In this embodiment, the through-gaps 32 are formed by spacers 84 fixed in the dosing gap, or more precisely, in the wall 4.2 of the leading lip 4 facing the dosing gap. In the present case, the spacers 84 are pin-like members with a semicircular head 84.2 which lies between the leading lip 4 and the trailing lip 8 and therefore determines the width of the through-gaps 32. According to FIG. 14*b*, the pin-like spacers 84 are offset with respect to each other as seen in the direction of flow of the liquid or pasty medium 12 in the dosing gap.

Figure 15:
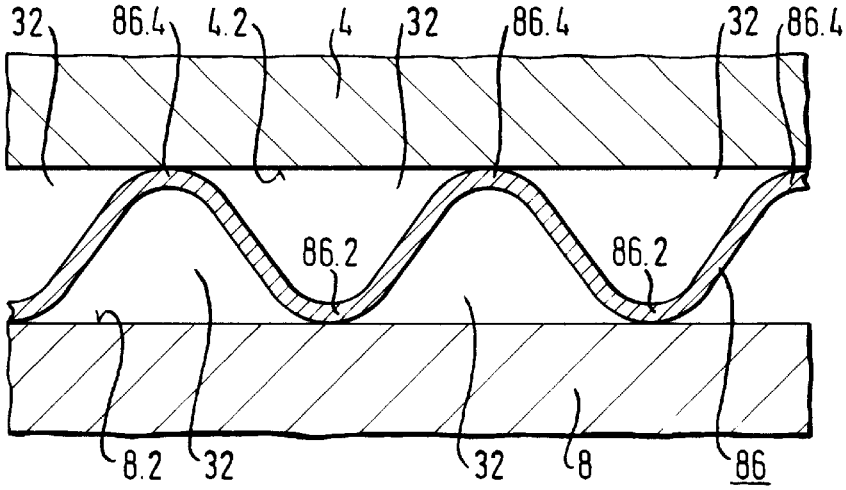
FIGS. 15 shows a schematic plan view of a further embodiment of the inventive through-gaps formed by a guide surface in the form of a spacer, FIGS. 16*a* and b show a schematic plan view and sectional view of a further embodiment of the inventive through-gaps formed by a spacer, FIGS. 17*a* and b show a schematic plan view and sectional view of another embodiment of the inventive through-gaps.

FIG. 15 shows,in a schematic plan view a further embodiment of inventive through-gaps formed by guide surfaces 86 simultaneously designed as spacers. As indicated in the drawing, the guide surface 86 is produced in the present case from a thin metal sheet deformed in a wavy manner, is arranged between the leading lip 4 and the trailing lip 8, lies against the lips 4, 8 to therefore simultaneously serve as a spacer. The guide surface 86 projects with its one end partially into the dosing gap while the other end extends beyond the outlet of the dosing gap towards the application roll 26 (not shown) opposite the dosing gap. The "wave valleys" 86.2 and "wave crests" 86.4 of the guide surface 86, which are bordered by the walls 4.2, 8.2 of the dosing gap or the lips 4, 8 and extend substantially parallel to the direction of flow of the liquid or pasty medium in the dosing gap, form the plurality of defined through-gaps 32 for the liquid or pasty medium. The guide surface 86 therefore fulfills two functions; on the one hand, it serves as a guide member for the liquid or pasty medium flowing out of the dosing gap on its way to the location of application and, on the other hand, it fulfills the function of the mentioned through-gaps 32. The embodiment according to FIG. 15 can naturally also be designed purely as a spacer. In this case, the sections of the guide surface 86 projecting beyond the outlet of the dosing gap are not present so that a spacer results, the appropriate cross-sectional shape of which defines the through-gaps 32.

Figure 16A:
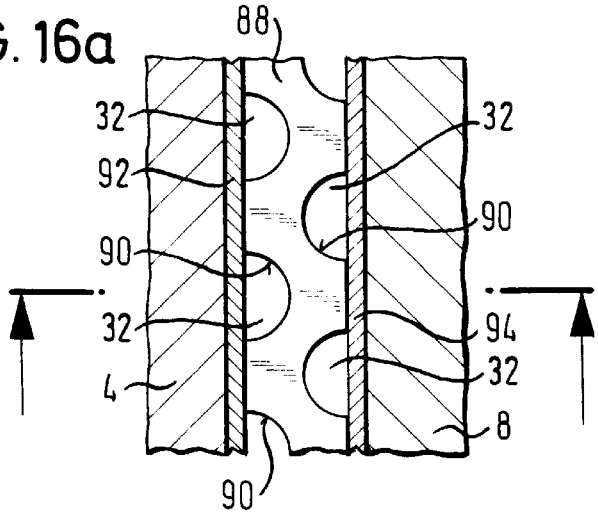
Figure 16B:
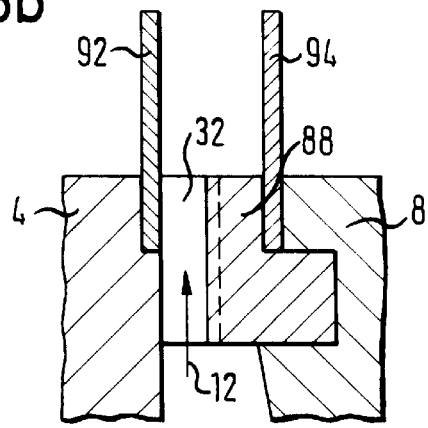

In FIGS. 16*a* and 16*b*, a schematic plan view and sectional view of a further embodiment of the inventive through-gaps 32 formed by a spacer 88 is shown. The spacer 88 formed at its sides associated with the leading lip 4 and the trailing lip 8 with opposing, offset half-round and groove-like recesses 90 is bordered by two straight guide surfaces 92, 94 which project respectively with one end partially into the dosing gap and extend with the respective other end beyond the outlet of the dosing gap. The groove-like recesses bordered on the sides by the guide surfaces 92, 94 form the throughgaps 32 for the liquid or pasty medium 12.

Figure 17A:
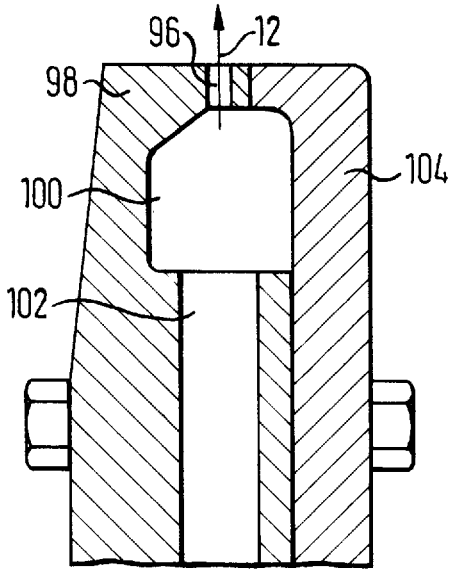
Figure 17B:
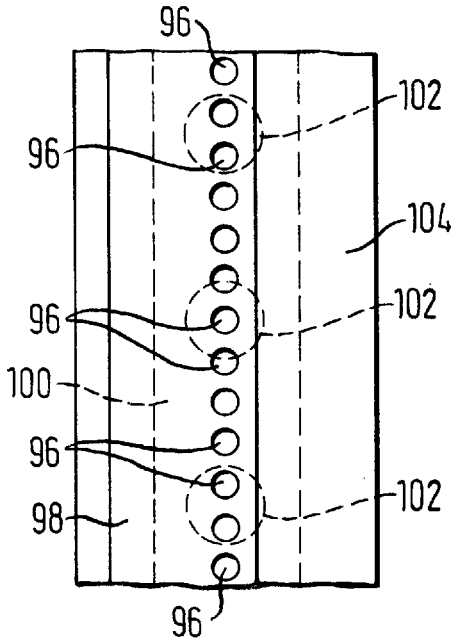

FIGS. 17*a* and b show a schematic plan view and sectional view of another embodiment of the inventive through-gaps, FIG. 17*a* being shown in a mode of illustration analogous to that of FIG. 2. In this case, the through-gaps 32 are formed by a plurality of adjacent through-openings, i.e. by a plurality of bores 96 with a constant diameter. The bores 96 are provided in a wall section 98 of the application unit opposite the application roll at which the outlet of the dosing gap is provided in accordance with the previously described variants. With reference to the direction of flow of the liquid or pasty medium 12 in the bores 96, there is provided in front of the through-openings 96 a distribution channel 100 communicating with the openings 96 and extending substantially parallel to the longitudinal extension of the dosing gap, wherein feed channels 102 for the liquid or pasty medium 12 open into the distribution channel. One side of the distribution channel 100 and the bores 96 forming the through-openings are closed in the present case by a removable lid 104 so that the distribution channel 100 and the bores 96 are accessible for cleaning purposes.

A method for the uniform dosing of a liquid or pasty medium 12 in an application unit follows from the preceding description, the liquid or pasty medium 12 being guided through a regulating location in the form of a plurality of defined through-gaps 32. By changing the area of passage of the through-gaps 32, the amount of liquid or pasty medium 12 applied can be regulated.

Figure 18:
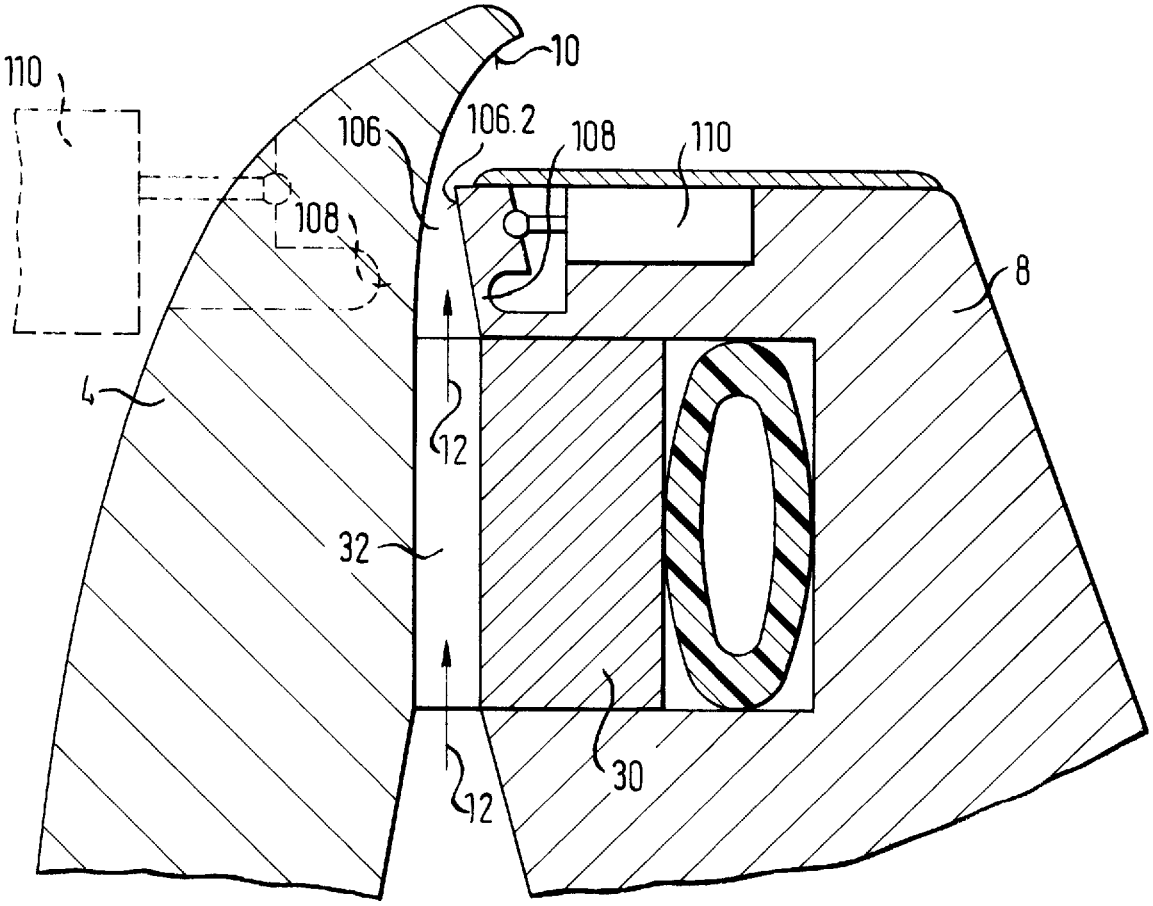
FIG. 18 shows a schematic enlarged view of a fourth embodiment of an inventive application unit analogous to the view according to FIG. 2.

A schematically enlarged view of a fourth preferred embodiment of the inventive application unit is illustrated in FIG. 18 in a manner analogous to the illustration in FIG. 2. As can be clearly recognized in this drawing, a flow channel 106 tapering in the direction of flow of the liquid or pasty medium 12 adjoins directly with the outlet side of the through-gaps 32.

In the present exemplary embodiment, the flow channel 106 has an inlet cross section which substantially corresponds to the total outlet cross section of the through-gaps 32 and tapers continuously in the direction of flow of the liquid or pasty medium 12. The outlet of the flow channel 106 lies in the area of a section of the leading lip 4 which passes into the concave deflecting surface 10 such that the liquid or pasty medium 12 exiting the flow channel 106 is guided substantially tangentially to the deflecting surface 10 and deflected accordingly at this location.

As can also be seen in FIG. 18, a local thin part 108 is provided in the trailing lip 8 in the area of the outlet side of the through-gaps 32 such that the flow cross section of the flow channel 106 is adjustable, i.e. the relationship of the inlet cross section to the outlet cross section of the flow channel 106 is adjustable as a result. The thin location 108 corresponds to a hinged connection and permits swinging within a certain swinging range, i.e. a rotary movement of a section of the trailing lip 8 lying above the thin part 108 in the drawing and forming a wall 106.2 of the flow channel 106, the swinging taking place in an elastic manner about an axis passing through the thin part 108 and extending substantially parallel to the longitudinal axis of the beam 20.

An adjusting means 110 for adjusting the flow cross section of the flow channel 106 is also provided on the trailing lip 8. In principle, this can be any adjusting means suitable for the intended use and comprise a mechanical, hydraulic, pneumatic, electrical, thermal, magnetic, magnetostrictive or piezoelectric adjusting mechanism or the like. Upon actuation of the adjusting means 110, the wall 106.2 of the flow channel 106 located to the right in FIG. 18 is moved in a pivoting manner about an axis through the thin part 108 and towards or away from the leading lip 4 to change the flow cross section of the flow channel. 106. Naturally, it is also possible in general to design the flow channel 106 and the adjusting means 110 in such a manner that an adjustment does not take place by means of a rotary movement, but a translatory movement or even a combination thereof.

Figure 19:
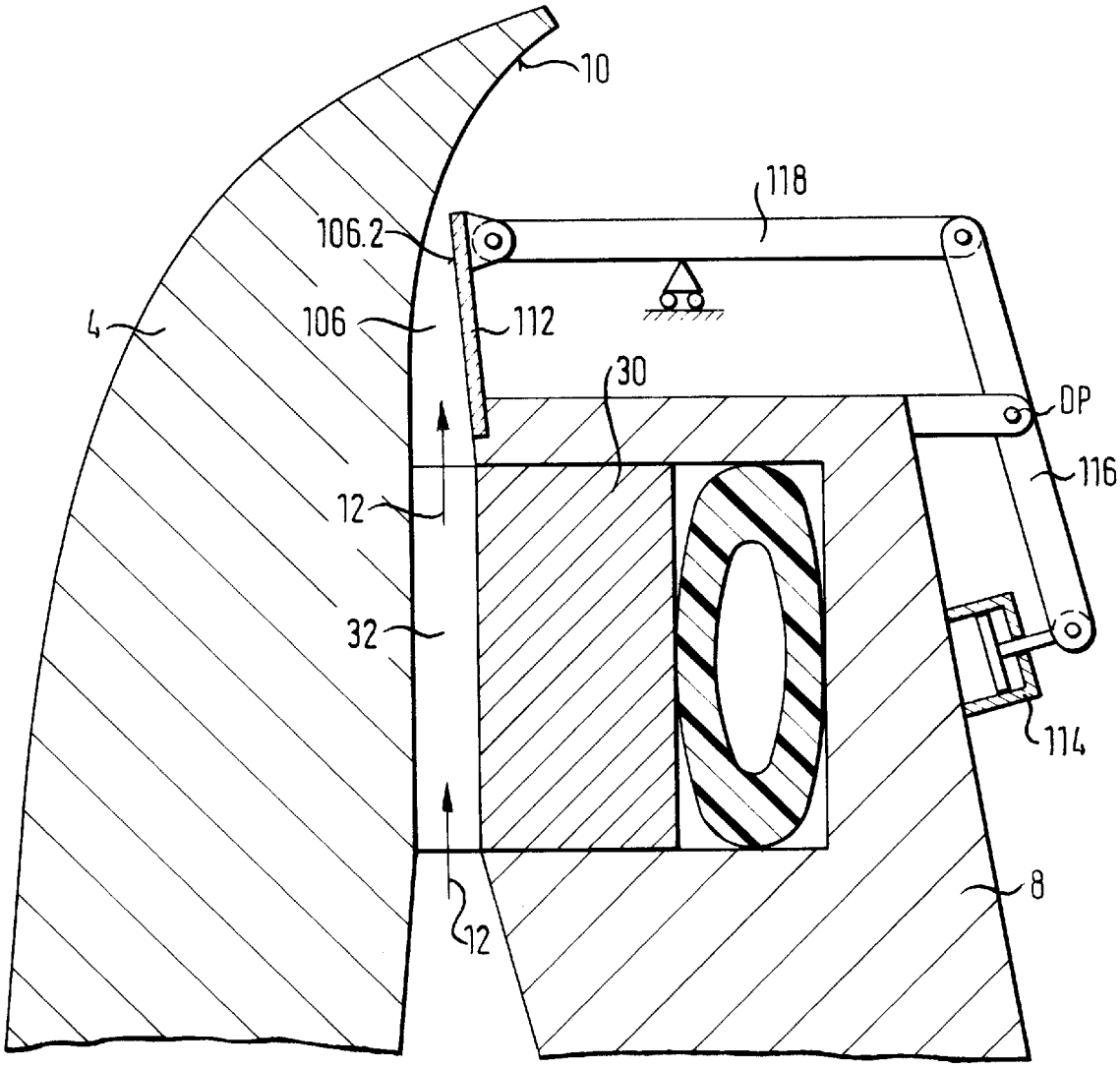
FIG. 19 shows a schematic cross-sectional view of a partial area of a fifth exemplary embodiment of an inventive application unit.

FIG. 19 shows a schematic cross-sectional view of a partial area of a fifth embodiment of an inventive application unit in a manner of illustration which is analogous to that in FIG. 18. As can be seen in FIG. 19, the wall 106.2 of the flow channel 106 at the trailing lip 8 is formed by a thin, plate-like or blade-like component 112, also called blade 112 in the following. The blade 112 is releasably or non-detachably connected with the adjacent area of the trailing lip 8 by means of a suitable securing system. As a result of an elastic deformation of the blade 112 by way of a suitable adjusting means, the section of the blade 112 facing the outlet side of the flow channel 106 is moved towards or away from the opposite leading lip 4 during this and the flow cross section of the flow channel 106 can again be changed. Instead of an elastic deformation of the blade 112, it is also possible to provide a pivoting or hinged connection of the blade 112 on a suitable section of the lip 4 and to realize the desired adjustment of the flow cross section of the flow channel 106 in this manner. The latter variant is not shown in the drawing. In the present case, the embodiment according to FIG. 19 also uses an adjusting means which comprises a suitable adjusting cylinder 114, a rocker 116 movable about the point of rotation DP and an arm 118 connected to the rocker 116 and to the blade 112.

In operation of the inventive application unit, the liquid or pasty medium 12 is initially supplied via the color distribution pipe 18, then passes into the compensation space 16 and flows through the feed channel 14 to the through-gaps 32 of the profiled strip 30, from which it then exits in an exactly volumetrically dosed manner and enters the inlet side of the flow channel 106 directly adjoining the through-gaps 32. On account of the shape of the through-gaps 32 in a wavy or sinusoidal form or the like, the flowing liquid or pasty medium 12 has a comparatively "dynamic" shape with wave crests and valleys directly after leaving the through-gaps 32. These wave crests and valleys are evened out into a uniform film in the passage through the tapering flow channel 106 such that the liquid or pasty medium 12 leaves the outlet of the flow channel 106 in the form of a free jet, which is not illustrated. As a result of the concave deflecting surface 10 of the leading lip 4, there then follows a deflection of the application jet in the direction of the tangent to the application roll 26 or, in the case of direct application, to the material web guided by the roll 26.

The liquid or pasty medium 12 is applied in the form of a free jet onto the surface of the application roll 26 and, after passing a downstream fine dosing means, not illustrated, at which the applied medium is doctored to set the desired application amount, the medium is then supplied to a roll gap through which a material web passes which consists of paper or board, or possibly of a textile material, which then takes up the liquid or pasty medium from the application roll 26.

Figure 20:
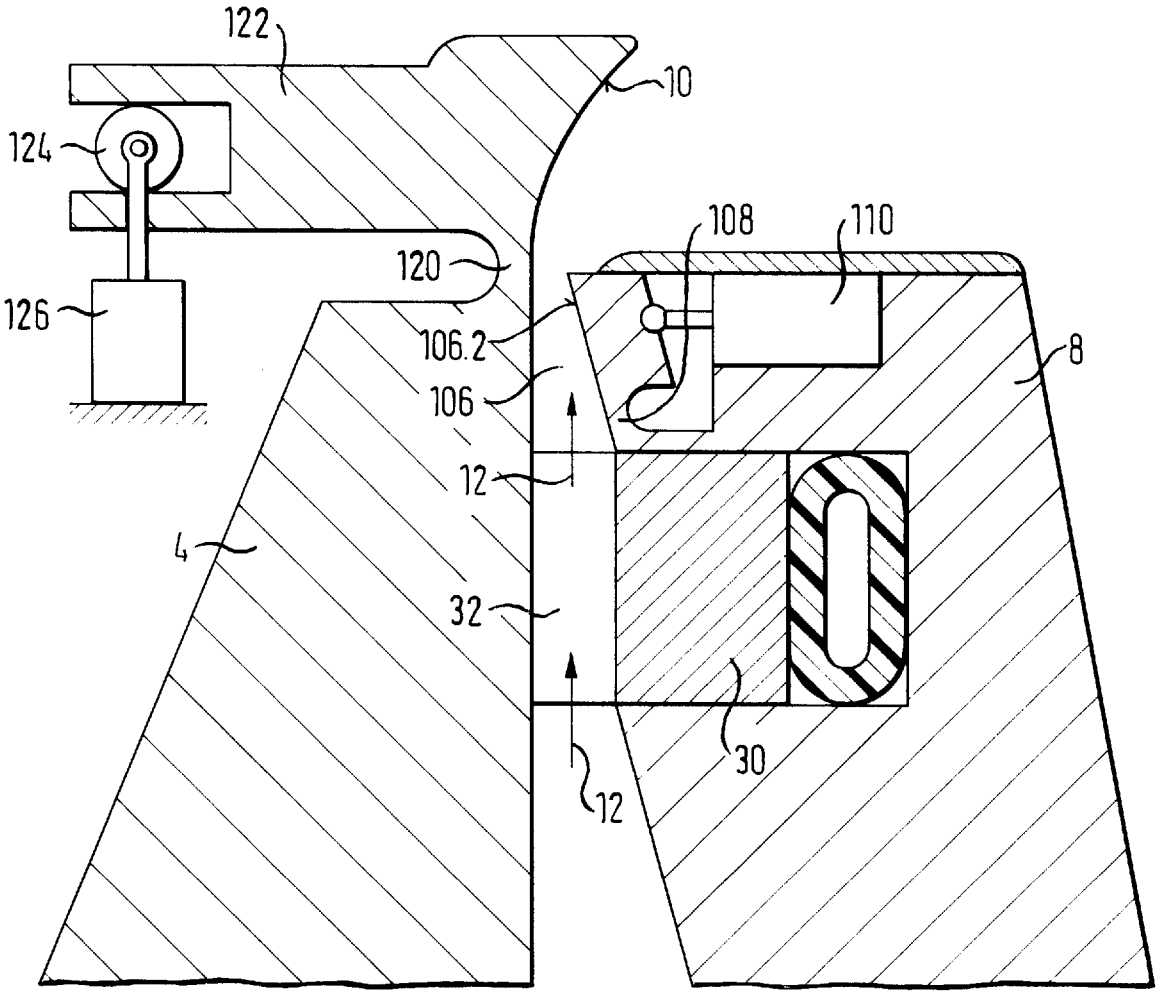
FIG. 20 shows a schematic cross-section view of a partial area of a sixth embodiment of an inventive application unit.

FIG. 20 shows a schematic cross-sectional view of a partial area of a third embodiment of an inventive application unit. This variant of the embodiment corresponds substantially to that according to FIG. 18, but includes the difference that the concave deflecting surface 10 in the area of the outlet of the flow channel 106 is capable of being swung about an axis extending substantially parallel to the longitudinal extension of the application unit. For this purpose, as can be clearly recognized in FIG. 20, a local thin part 120 is provided in the leading lip 4 in the area of the outlet of the flow channel 106. This local thin part 120 corresponds to a hinged connection and, by way of flexible deformation, it allows movement within a certain pivoting range of the section of the leading lip 4 which lies above the thin part 120 in the drawing and forms the concave deflecting surface 10, the pivoting taking place about an axis extending through the thin part 120 and parallel to the longitudinal axis of the beam 20. In contrast, the section of the leading lip 4 lying below the local thin part 120 remains rigid. In this manner, the angle of impingement on the application roll 26 of the free jet of the liquid or pasty medium 12 deflected by the concave deflecting surface 10 can be adjusted without any alteration of the setting of the flow channel 106 occuring.

As can also be seen in FIG. 20, the side of the concave deflecting surface 10 opposite the flow channel 106 is provided with a lever arm 122 by means of which bending forces can be introduced into the concave deflecting surface 10 and the local thin part 120 as a result of the application of a lever force to produce a swinging of the deflecting surface 10 resulting from bending deformation at the thin part 120. For this purpose, the free end of the lever arm 122 is attached by means of a connecting member 124 to a suitable adjusting means 126 for the deflecting surface, for example a pneumatic or hydraulic displacement cylinder, an electric servomotor, a setting or adjusting screw, a cam or the like.

The concave deflecting surface 10 according to FIG. 20 which is used to adjust the angle of impingement can be continuous along the length of the application unit or can also be subdivided into several zones which are adjustable independently of each other, i.e. these can be pivoted zone by zone. In this manner, the angle of impingement of the liquid or pasty medium onto the moving material web can be locally altered and the application onto the material web can be influenced accordingly. For example, this serves to compensate local manufacturing inaccuracies or to produce a specific transverse profile on the material web. By uniformly pivoting the concave deflecting surface zone by zone, it is naturally also possible to achieve a unitary adjustment of the angle of impingement along the entire length of the application unit.

The embodiments explained above in connection with FIGS. 1 to 20 merely represent examples so that the application unit can vary considerably within the scope of the invention. For example, it is conceivable that an individual section of the profiled strip has different gap shapes and/or dimensions.

An individual profiled strip can also have two different types of gaps along the entire profiled strip length which are arranged at opposite sides of the profiled strips so that a different gap dosing is achieved by removing and turning the profiled strip. Contrary to the above examples, a profiled strip can also be held at two sides and project partially into the respective opposite lip 4 or 8. The side of the profiled strip 30 facing a lip 4 or 8 and, thus, the free gap openings lying perpendicular to the plane of flow within the feed channel 14, can additionally be provided with a closed profiled section so that the through-gaps 32 of the profiled strip are purely through-openings. It is also intended that the profiled strip, in particular that which is formed as an endless loop, has further shapes which serve to cooperate with a drive member for moving the profiled strip, such as a toothed belt disk, a V-belt pulley or the like.

It is obvious that the profiled strip 30 can be arranged on the leading lip 4 instead of the trailing lip 8. In this case, the additional and auxiliary means described in connection with the above examples can be used in a substantially analogous manner. Further, depending on the type of use, the comb-like gap profile provided on the leading lip 4 and/or the trailing lip 4 can also be used in combination with one or more profiled strips to form a plurality of through-gaps extending substantially parallel to the direction of flow of the liquid or pasty medium 12 in the feed channel 14.

Additionally, it is also possible in principle to omit the concave deflecting surface 10 or to use a convexly curved deflecting surface instead of this, or the free end of one lip can extend as a straight guide surface beyond the free end of the second lip. It is also conceivable that the flow channel 106 tapers discontinuously and it is not even absolutely necessary that a tapering section of the flow channel 106 directly adjoins the outlet side of the through-gaps 32. In addition to or instead of the adjusting means described above and arranged on the trailing lip 8, it is also possible to provide a comparable adjusting means 110 on the leading lip 4. Such an embodiment is indicated in FIG. 18 by dashed lines. In principle, any means suitable for the intended purpose can be used as the adjusting means. The invention also provides for that the flow cross section of the flow channel is not only adjustable in a unitary manner across substantially the entire width of the application unit, but that it is also locally selective, i.e. it is adjustable, for example, zone by zone across the width of the application unit. Accordingly, several, preferably independently controllable adjusting means are provided. Such an embodiment is not shown in the drawings.

Reference signs in the claims, description and drawings merely serve for better understanding of the invention and do not limit the scope.

We claim:

1. An application unit for the direct or indirect application of a liquid or pasty medium onto a moving material web, comprising:

at least one feed channel;

a leading lip and a trailing lip defining a dosing gap therebetween, said dosing gap being configured as a free jet nozzle and disposed in fluid communication with said at least one feed channel, said dosing gap having a subdivided structure as viewed in a direction of flow of the medium in said at least one feed channel, said dosing cap having a plurality of through-gaps for the medium; and said subdivided structure comprising a plurality of tooth-like material sections disposed between said leading lip and said trailing lip, each tooth-like material section having an attached end, a head, and a height extending from said attached end to said head, said height having an orientation transverse to each of said leading lip and said trailing lip;

wherein each said through-gap is defined by at least one corresponding said tooth-like material section and one of said leading lip and said trailing lip.

2. An application unit according to claim 1, wherein the through-gaps have a passage cross section which reduces in said direction of flow of the medium.

3. An application unit according to claim 1, wherein the through-gaps are configured as a plurality of predetermined through-openings provided at or in an outlet of the dosing gap.

4. An application unit according to claim 3, further comprising a distribution channel communicating with the through-openings, said distribution channel being arranged substantially parallel to a longitudinal extension of the dosing gap, said distribution channel further being disposed in front of the through-openings relative to said direction of flow of the medium.

5. An application unit according to claim 1, further comprising at least one profiled spacer arranged in or at the dosing gap, said at least one profiled spacer defining the through-gaps.

6. An application unit according to claim 5, wherein the at least one spacer is bordered by two guide surfaces extending beyond an outlet of the dosing gap.

7. An application unit according to claim 1, further comprising at least one guide surface defining the through-gaps, said at least one guide surface being positioned in or on the dosing gap.

8. An application unit according to claim 1, wherein at least one of the leading lip and the trailing lip includes a comb-like gap profile for formation of a plurality of through-gaps extending substantially parallel to said direction of flow of the medium flowing in the feed channel.

9. An application unit according to claim 8, wherein at least one guide surface for the medium is arranged between the leading lip and the trailing lip.

10. An application unit according to claim 1, further comprising at least one profiled strip in the dosing gap, said at least one profiled strip having a plurality of defined through-gaps that extend substantially parallel to said direction of flow of the medium in the feed channel.

11. An application unit according to claim 1, wherein at least one of the leading lip and the trailing lip include a comb-like gap profile for formation of the plurality of through-gaps, said through-gaps extending substantially parallel to said direction of flow of the medium flowing in the feed channel, and further comprising at least one profiled strip in the dosing gap having a plurality of defined through-gaps that extend substantially parallel to the direction of flow of the medium in the feed channel.

12. An application unit according to claim 10, wherein the profiled strip has a longitudinal direction and is movable in a direction substantially parallel to the longitudinal direction.

13. An application unit according to claim 12, further comprising at least one moving mechanism for moving the profiled strip in the direction substantially parallel to the longitudinal direction of the profiled strip.

14. An application unit for the direct or indirect application of a liquid or pasty medium onto a moving material web, comprising:

at least one feed channel;

a leading lip and a trailing lip defining a dosing gap therebetween, said dosing gap being configured as a free jet nozzle and disposed in fluid communication with said at least one feed channel, said dosing gap being subdivided in a comb-like manner and having a plurality of through-gaps for the medium; and at least two profiled strips in the dosing gap, each said profiled strip having a plurality of defined through-gaps that extend substantially parallel to a direction of flow of the medium in the feed channel, said at least two profiled strips being arranged behind one another in the direction of flow of the medium in the feed channel, the profiled strips having a longitudinal direction and being displacable relative to each other in a direction substantially parallel to the longitudinal direction.

15. An application unit according to claim 14, further comprising at least one moving mechanism for moving the profiled strips in a direction substantially parallel to the longitudinal direction.

16. An application unit for the direct or indirect application of a liquid or pasty medium onto a moving material web, comprising:

at least one feed channel;

a leading lip and a trailing lip defining a dosing gap therebetween, said dosing gap being configured as a free let nozzle and disposed in fluid communication with said at least one feed channel, said dosing gap being subdivided in a comb-like manner and having a plurality of through-gaps for the medium; and two profiled strips in the dosing gap, each said profiled strip having a plurality of defined through-gaps that extend substantially parallel to a direction of flow of the medium in the feed channel, said two profiled strips being arranged opposite one another in the dosing gap, the respective through-gaps of which together form through-openings for the medium.

17. An application unit according to claim 16, further comprising at least one guide surface arranged between the two opposing profiled strips.

18. An application unit according to claim 10, wherein the at least one profiled strip is moveable in a direction towards one of the leading lip and trailing lip substantially transverse to the direction of flow of the medium in the feed channel.

19. An application unit according to claim 16, wherein the two profiled strips are moveable in a direction towards one of the leading lip and trailing lip substantially transverse to the direction of flow of the medium in the feed channel.

20. An application unit according to claim 10, further comprising at least one pressing means which directly or indirectly presses the at least one profiled strip in a direction towards one of the leading lip and trailing lip substantially perpendicular to the direction of flow of the medium in the feed channel.

21. An application unit according to claim 16, further comprising at least one pressing means which directly or indirectly presses the two profiled strips in a direction towards one of the leading lip and trailing lip substantially perpendicular to the direction of flow of the medium in the feed channel.

22. An application unit according to claim 20, wherein the pressing means is a tube-like member which deforms under the influence of an effective medium.

23. An application unit according to claim 21, wherein the pressing means is a tube-like member which deforms under the influence of an effective medium.

24. An application unit according to claim 10, wherein the at least one profiled strip has a cross-sectional shape which is one of polygonal, round, oval and segment-like.

25. An application unit according to claim 10, wherein the at least one profiled strip is comprised of an elastic material.

26. An application unit according to claim 10, wherein the at least one profiled strip is comprised of a bronze material.

27. An application unit for the direct or indirect application of a liquid or pasty medium onto a moving material web, comprising:

at least one feed channel;

a leading lip and a trailing lip defining a dosing gap therebetween, said dosing gap being configured as a free let nozzle and disposed in fluid communication with said at least one feed channel, said dosing gap being subdivided in a comb-like manner and having a plurality of through-gaps for the medium; and at least one profiled strip in the dosing gap, said at least one profiled strip having a plurality of defined through-gaps that extend substantially parallel to a direction of flow of the medium in the feed channel, the at least one profiled strip having a longitudinal direction and being configured as an endless loop in the longitudinal direction.

28. An application unit according to claim 10, wherein the at least one profiled strip contacts at least one of the leading lip and the trailing lip.

29. An application unit according to claim 10, wherein the through-gaps of the profiled strip include one of a substantially wave-like and sinusoidal shape in longitudinal cross section.

30. An application unit according to claim 10, wherein the through-gaps of the at least one profiled strip have a gap depth of between approximately 0.5 mm and 4 mm.

31. An application unit according to claim 10, wherein the at least one profiled strip has one of:

through-gaps which are substantially trapezoidal shaped in longitudinal cross section; and material sections bordering the through-gaps with a tooth-like shape.

32. An application unit according to claim 31, wherein the material sections have a module within a range of approximately 0.25 mm and 3 mm.

33. An application unit according to claim 10, further comprising a holding means, and wherein the at least one profiled strip is releasably or undetachably held in or on the holding means.

34. An application unit according to claim 33, wherein the holding means is flexible.

35. An application unit according to claim 33, wherein the holding means defines at least one section other feed channel.

36. An application unit according to claim 33, further comprising a distribution pipe, and wherein the holding means has a securing section projecting at least partially into the distribution pipe.

37. An application unit according to claim 33, wherein the holding means includes a filtering means.

38. An application unit according to claim 33, wherein the holding means includes a sonotrode.

39. An application unit according to claim 10, further comprising a running-off surface which adjoins the at least one profiled strip at a side of the profiled strip facing away from the leading lip and the trailing lip.

40. An application unit according to claim 10, wherein the at least one feed channel continuously tapers towards the at least one profiled strip.

41. An application unit according to claim 10, further comprising at least one cleaning means for cleaning the at least one profiled strip.

42. An application unit according to claim 1, further comprising a flow channel which tapers in the direction of flow of the medium and adjoins an outlet side of the through-gaps.

43. An application unit according to claim 42, wherein the flow channel tapers one of continuously and discontinuously.

44. An application unit according to claim 42, wherein the flow channel has a flow cross section which is adjustable.

45. An application unit according to claim 44, wherein the flow cross section is adjustable across an entire width of the application unit.

46. An application unit according to claim 44, wherein the flow cross section is locally selectively adjustable.

47. An application unit according to claim 44, comprising a local thin part which is located in a region of an outlet side of the through-gaps in at least one of the leading lip and the trailing lip, with the local thin part effecting the adjustability of the flow cross section of the flow channel.

48. An application unit according to claim 44, further comprising at least one profiled strip disposed between the at least one feed channel and the flow channel, wherein the flow channel has at least one wall configured as one of a plate-like and blade-like structural part which is pivotally movable towards and away from one of the leading lip and the trailing lip, the structural part providing the adjustability of the flow cross section of the flow channel.

49. An application unit according to claim 44, further comprising at least one adjusting means for adjusting the flow cross section of the flow channel.

50. An application unit according to claim 49, wherein the adjusting means is arranged in or on at least one of the leading lip and the trailing lip.

51. An application unit according to claim 49, wherein the adjusting means includes one of a mechanical, hydraulic, pneumatic, electric, thermal, magnetic, magnetostrictive and piezoelectric adjusting mechanism.

52. An application unit according to claim 42, further comprising a concave deflecting surface for the medium which adjoins the flow channel and is capable of being swung in an area of an outlet of the flow channel about an axis extending substantially parallel to a longitudinal direction of the application unit.

53. An application unit according to claim 52, wherein the concave deflecting surface is capable of being swung in the area of the outlet of the flow channel in a zone by zone manner about the axis extending substantially parallel to the longitudinal direction of the application unit.

* * * * *

UNITED STATES PATENT AND TRADEMARK OFFICE

CERTIFICATE OF CORRECTION

PATENT NO. : 5,858,096

DATED : January 12, 1999

INVENTOR(S) : Zygmunt Madrzak, Manfred Ueberschär, Benjamin Méndez; Michael Trefz, Ingo Gottwald, Martin F. Kusterman.

It is certified that error appears in the above-identified patent and that said Letters Patent is hereby corrected as shown below:

In the Drawings:

Fig. 2 Sheet 2 of 14

Delete section line "A-A", and substitute section line --3-3-- therefor.

Column 15

Line 9, delete "4" and substitute --54-- therefor; and
Line 9, delete "54" and substitute --4-- therefor.

Column 21

Line 12, delete "cap" and substitute --gap-- therefor.

Column 22

Line 40, delete "let" and substitute --jet-- therefor.

Column 23

Line 26, delete "let" and substitute --jet-- therefor.

Signed and Sealed this

Seventeenth Day of August, 1999

*Attest:*

Q. TODD DICKINSON

*Attesting Officer*

*Acting Commissioner of Patents and Trademarks*